US009060409B2

(12) United States Patent
Bowers et al.

(10) Patent No.: US 9,060,409 B2
(45) Date of Patent: Jun. 16, 2015

(54) MOBILE DEVICE APPLICATION FOR REMOTELY CONTROLLING AN LED-BASED LAMP

(71) Applicant: Lumenetix, Inc., Scotts Valley, CA (US)

(72) Inventors: David Bowers, San Jose, CA (US); Thomas Poliquin, Aptos, CA (US); Jay Hurley, Watsonville, CA (US)

(73) Assignee: LUMENETIX, INC., Scotts Valley, CA (US)

( * ) Notice: Subject to any disclaimer, the term of this patent is extended or adjusted under 35 U.S.C. 154(b) by 260 days.

(21) Appl. No.: 13/766,745

(22) Filed: Feb. 13, 2013

(65) Prior Publication Data

US 2013/0221852 A1 Aug. 29, 2013

Related U.S. Application Data

(60) Provisional application No. 61/598,180, filed on Feb. 13, 2012.

(51) Int. Cl.
*H05B 33/08* (2006.01)

(52) U.S. Cl.
CPC ..... *H05B 33/0863* (2013.01); *H05B 33/086* (2013.01); *H05B 33/0869* (2013.01)

(58) Field of Classification Search
USPC ..... 315/209 R, 291, 294, 297, 307, 312, 315/131, 158; 362/231; 398/115, 183
See application file for complete search history.

(56) References Cited

U.S. PATENT DOCUMENTS

| | | | | |
|---|---|---|---|---|
| 5,099,348 | A | 3/1992 | Huddleston et al. | |
| 5,457,478 | A | 10/1995 | Frank | |
| 6,118,230 | A * | 9/2000 | Fleischmann | 315/312 |
| 6,128,117 | A | 10/2000 | Kim | |
| 6,411,046 | B1 | 6/2002 | Muthu | |
| 7,423,387 | B2 | 9/2008 | Robinson | |
| 8,796,948 | B2 | 8/2014 | Weaver et al. | |
| 2002/0097000 | A1 | 7/2002 | Muthu et al. | |
| 2002/0101197 | A1 * | 8/2002 | Lys et al. | 315/291 |

(Continued)

FOREIGN PATENT DOCUMENTS

| | | | |
|---|---|---|---|
| JP | 2005-011628 | A | 1/2005 |
| JP | 2006-059605 | A | 3/2006 |

(Continued)

OTHER PUBLICATIONS

Co-Pending U.S. Appl. No. 12/396,399 of Weaver, M.D., filed Mar. 2, 2009.

(Continued)

*Primary Examiner* — Tung X Le
*Assistant Examiner* — Jonathan Cooper
(74) *Attorney, Agent, or Firm* — Perkins Coie LLP

(57) ABSTRACT

A mobile application is disclosed that allows a user to configure an LED-based lamp. The LED-based lamp has the capability of color matching color spectrums and calibrating its correlated color temperatures, brightness, and hue based on a color model. The mobile application can send or schedule commands actively or passively to activate the color matching and calibration process on the LED-based lamp. The mobile application can further receive status information regarding the LED-based lamp including fault detection, estimated life time, temperature, power consumption, or any combination thereof.

27 Claims, 16 Drawing Sheets

(56) References Cited

U.S. PATENT DOCUMENTS

| | | | | |
|---|---|---|---|---|
| 2002/0114155 | A1 | 8/2002 | Katogi et al. | |
| 2004/0008992 | A1 | 1/2004 | Nishimura | |
| 2004/0105264 | A1 | 6/2004 | Spero | |
| 2005/0030744 | A1 | 2/2005 | Ducharme et al. | |
| 2005/0047134 | A1 | 3/2005 | Mueller et al. | |
| 2005/0128751 | A1 | 6/2005 | Roberge et al. | |
| 2005/0248299 | A1* | 11/2005 | Chemel et al. | 315/312 |
| 2007/0183163 | A1 | 8/2007 | Daniel | |
| 2007/0248047 | A1 | 10/2007 | Shorty et al. | |
| 2008/0191631 | A1 | 8/2008 | Archenhold et al. | |
| 2009/0040750 | A1 | 2/2009 | Myer | |
| 2009/0184648 | A1 | 7/2009 | Colak et al. | |
| 2009/0218951 | A1 | 9/2009 | Weaver | |
| 2009/0267524 | A1 | 10/2009 | Draaijer et al. | |
| 2010/0110672 | A1 | 5/2010 | Durand et al. | |
| 2010/0188004 | A1 | 7/2010 | Baggen et al. | |
| 2010/0231363 | A1 | 9/2010 | Knibbe | |
| 2010/0244746 | A1 | 9/2010 | Van De Sluis et al. | |
| 2010/0301776 | A1 | 12/2010 | Feri et al. | |
| 2011/0044701 | A1 | 2/2011 | Schenk et al. | |

FOREIGN PATENT DOCUMENTS

| | | | |
|---|---|---|---|
| WO | WO-02/13490 | A2 | 2/2002 |
| WO | WO-02/47438 | A2 | 6/2002 |
| WO | WO-02/082283 | A2 | 10/2002 |
| WO | WO-02/082863 | A1 | 10/2002 |
| WO | WO-03/055273 | A2 | 7/2003 |
| WO | WO-2004/057927 | A1 | 7/2004 |
| WO | WO-2006/111934 | A1 | 10/2006 |
| WO | WO-2007/125477 | A2 | 11/2007 |

OTHER PUBLICATIONS

Co-Pending U.S. Appl. No. 12/782,038 of Weaver, M. et al., filed May 18, 2010.
Co-Pending U.S. Appl. No. 13/367,187 of Weaver, M.D., filed Feb. 6, 2012.
Co-Pending U.S. Appl. No. 13/627,926 of Weaver M.D., filed Sep. 26, 2012.
Co-Pending U.S. Appl. No. 13/655,679 of Weaver, M.D., filed Oct. 19, 2012.
Co-Pending U.S. Appl. No. 13/655,738 of Weaver, M.D., filed Oct. 19, 2012.
Co-Pending U.S. Appl. No. 13/766,695 of Bowers, D. et al., filed Feb. 13, 2013.
Co-Pending U.S. Appl. No. 13/766,707 of Bowers, D., filed Feb. 13, 2013.
Co-Pending U.S. Appl. No. 13/770,595 of Weaver, M.D., filed Feb. 19, 2013.
Co-Pending U.S. Appl. No. 13/848,628 of Weaver, M.D., filed Mar. 21, 2013.
Non-Final Office Action Mailed Sep. 23, 2011 in Co-Pending U.S. Appl. No. 12/396,399 of Weaver, M.D., filed Mar. 2, 2009.
Final Office Action Mailed Dec. 5, 2012 in Co-Pending U.S. Appl. No. 12/396,399 of Weaver, M.D., filed Mar. 2, 2009.
Non-Final Office Action Mailed Jan. 4, 2013 in Co-Pending U.S. Appl. No. 12/396,399 of Weaver, M.D., filed Mar. 2, 2009.
Notice of Allowance Mailed Mar. 20, 2013 in Co-Pending U.S. Appl. No. 12/396,399 of Weaver, M.D., filed Mar. 2, 2009.
Restriction Requirement mailed Mar. 25, 2013 for Co-Pending U.S. Appl. No. 12/782,038 of Weaver, M., filed May 18, 2010.
Non-Final Office Action Mailed Dec. 4, 2012 in Co-Pending U.S. Appl. No. 13/627,926 Weaver, M.D., filed Sep. 26, 2012.
Non-Final Office Action Mailed Feb. 28, 2013 in Co-Pending U.S. Appl. No. 13/655,738, Weaver, M.D., filed Oct. 19, 2010.
International Search Report mailed Dec. 28, 2010 for International Patent Application No. PCT/2010/035296 filed May 18, 2010, pp. 1-8.
Written Opinion mailed Dec. 28, 2010, for International Patent Application No. PCT/2010/035295 filed May 18, 2010, pp. 1-5.
U.S. Appl. No. 14/447,448 by Weaver, M. et al., filed Jul. 30, 2014.
Non-Final Office Action mailed Dec. 5, 2013, for Co-Pending U.S. Appl. No. 12/782,038 by Weaver, M., filed May 18, 2010.
Notice of Allowance mailed May 13, 2014, for Co-Pending U.S. Appl. No. 12/782,038 by Weaver, M., filed May 18, 2010.

* cited by examiner

| | measurement A | measurement B | measurement C | measurement D | measurement E |
|---|---|---|---|---|---|
| string 1 | on | off | on | off | off |
| string 2 | on | off | off | on | off |
| string 3 | on | off | off | off | on |

| | measurement F | measurement G | measurement H |
|---|---|---|---|
| string 1 | on | on | off |
| string 2 | on | off | on |
| string 3 | off | on | on |

*FIG. 5*

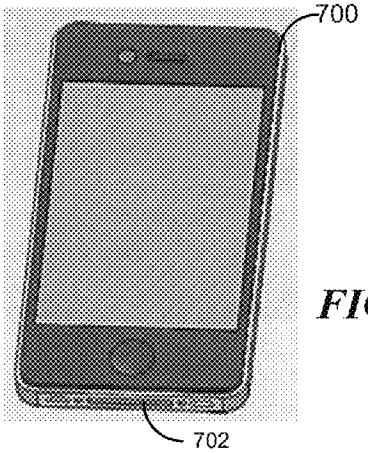
FIG. 7A
FIG. 7B
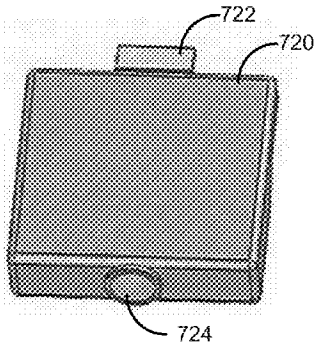
FIG. 7C
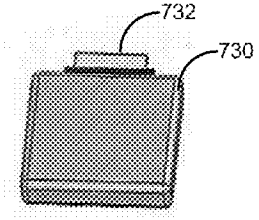
FIG. 7D
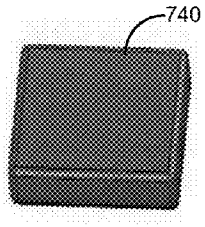
FIG. 7E

MOBILE DEVICE APPLICATION FOR REMOTELY CONTROLLING AN LED-BASED LAMP

CROSS-REFERENCES TO RELATED APPLICATIONS

This application claims the benefit of U.S. Provisional Patent Application Ser. No. 61/598,180 filed Feb. 13, 2012. This application is related to U.S. application Ser. No. 12/782,038, entitled, "LAMP COLOR MATCHING AND CONTROL SYSTEMS AND METHODS", filed May 18, 2010. These applications are incorporated herein in their entirety.

BACKGROUND

Conventional systems for controlling lighting in homes and other buildings suffer from many drawbacks. One such drawback is that these systems rely on conventional lighting technologies, such as incandescent bulbs and fluorescent bulbs. Such light sources are limited in many respects. For example, such light sources typically do not offer long life or high energy efficiency. Further, such light sources offer only a limited selection of colors, and the color or light output of such light sources typically changes or degrades over time as the bulb ages. In systems that do not rely on conventional lighting technologies, such as systems that rely on light emitting diodes ("LEDs"), long system lives are possible and high energy efficiency can be achieved. However, in such systems issues with color quality can still exist.

A light source can be characterized by its color temperature and by its color rendering index ("CRI"). The color temperature of a light source is the temperature at which the color of light emitted from a heated black-body radiator is matched by the color of the light source. For a light source which does not substantially emulate a black body radiator, such as a fluorescent bulb or an LED, the correlated color temperature ("CCT") of the light source is the temperature at which the color of light emitted from a heated black-body radiator is approximated by the color of the light source. The CRI of a light source is a measure of the ability of a light source to reproduce the colors of various objects faithfully in comparison with an ideal or natural light source. The CCT and CRI of LED light sources is typically difficult to tune and adjust. Further difficulty arises when trying to maintain an acceptable CRI while varying the CCT of an LED light source.

SUMMARY

A mobile application is disclosed that allows a user to configure an LED-based lamp. The LED-based lamp has the capability of color matching color spectrums and calibrating its correlated color temperatures, brightness, and hue based on a color model. The mobile application can send or schedule commands actively or passively to activate the color matching and calibration process on the LED-based lamp. The mobile application can further receive status information regarding the LED-based lamp including fault detection, estimated life time, temperature, power consumption, or any combination thereof.

BRIEF DESCRIPTION OF THE DRAWINGS

Examples of a remotely controllable LED-based lighting system are illustrated in the figures. The examples and figures are illustrative rather than limiting.

FIG. 5 shows a table of various types of measurement taken during the calibration process for a three-string LED lamp.

FIGS. 7A-7E show different example controller configurations that use a smart phone for presenting a graphical user interface to a user to control an LED-based lamp.

DETAILED DESCRIPTION

An LED-based lamp is used to substantially reproduce a target light. The correlated color temperature (CCT) of light generated by the lamp is tunable by adjusting the amount of light contributed by each of the LED strings in the lamp. The target light is decomposed into different wavelength bands by using a multi-element sensor that has different wavelength passband filters. Light generated by the LED-based lamp is also decomposed into the same wavelength bands using the same multi-element sensor and compared. A color model for the lamp provides information on how hard to drive each LED string in the lamp to generate light over a range of CCTs, and the color model is used to search for the appropriate operating point of the lamp to reproduce the target light. Further, the LED-based lamp can calibrate the output of its LED strings to ensure that the CCT of the light produced by the lamp is accurate over the life of the lamp. A controller allows a user to remotely command the lamp to reproduce the target light or calibrate the lamp output.

In one embodiment, the color model is developed by an expert system. Different custom color models can be developed for a lamp, and the color models are then stored at the lamp.

In one embodiment, a user interface for the controller can be provided on a smart phone. The smart phone then communicates with an external unit either through wired or wireless communication, and the external unit subsequently communicates with the LED-based lamp to be controlled.

Various aspects and examples of the invention will now be described. The following description provides specific details for a thorough understanding and enabling description of these examples. One skilled in the art will understand, however, that the invention may be practiced without many of these details. Additionally, some well-known structures or functions may not be shown or described in detail, so as to avoid unnecessarily obscuring the relevant description.

The terminology used in the description presented below is intended to be interpreted in its broadest reasonable manner, even though it is being used in conjunction with a detailed description of certain specific examples of the technology. Certain terms may even be emphasized below; however, any terminology intended to be interpreted in any restricted manner will be overtly and specifically defined as such in this Detailed Description section.

The Lighting System

Figure 1:
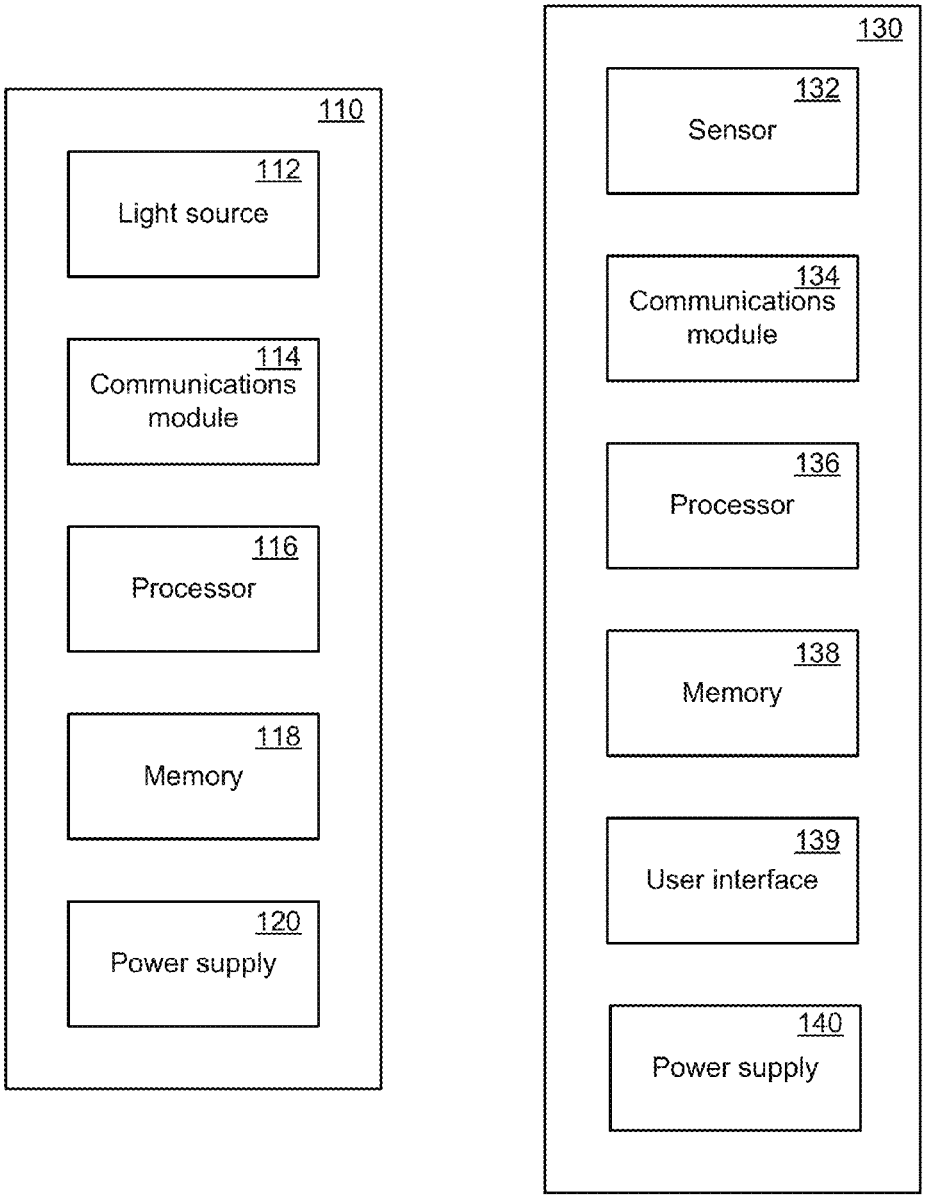
FIG. 1 shows a block diagram illustrating an example of an LED-based lamp or lighting node and a controller for the LED-based lamp or lighting node.
Figure 2A:
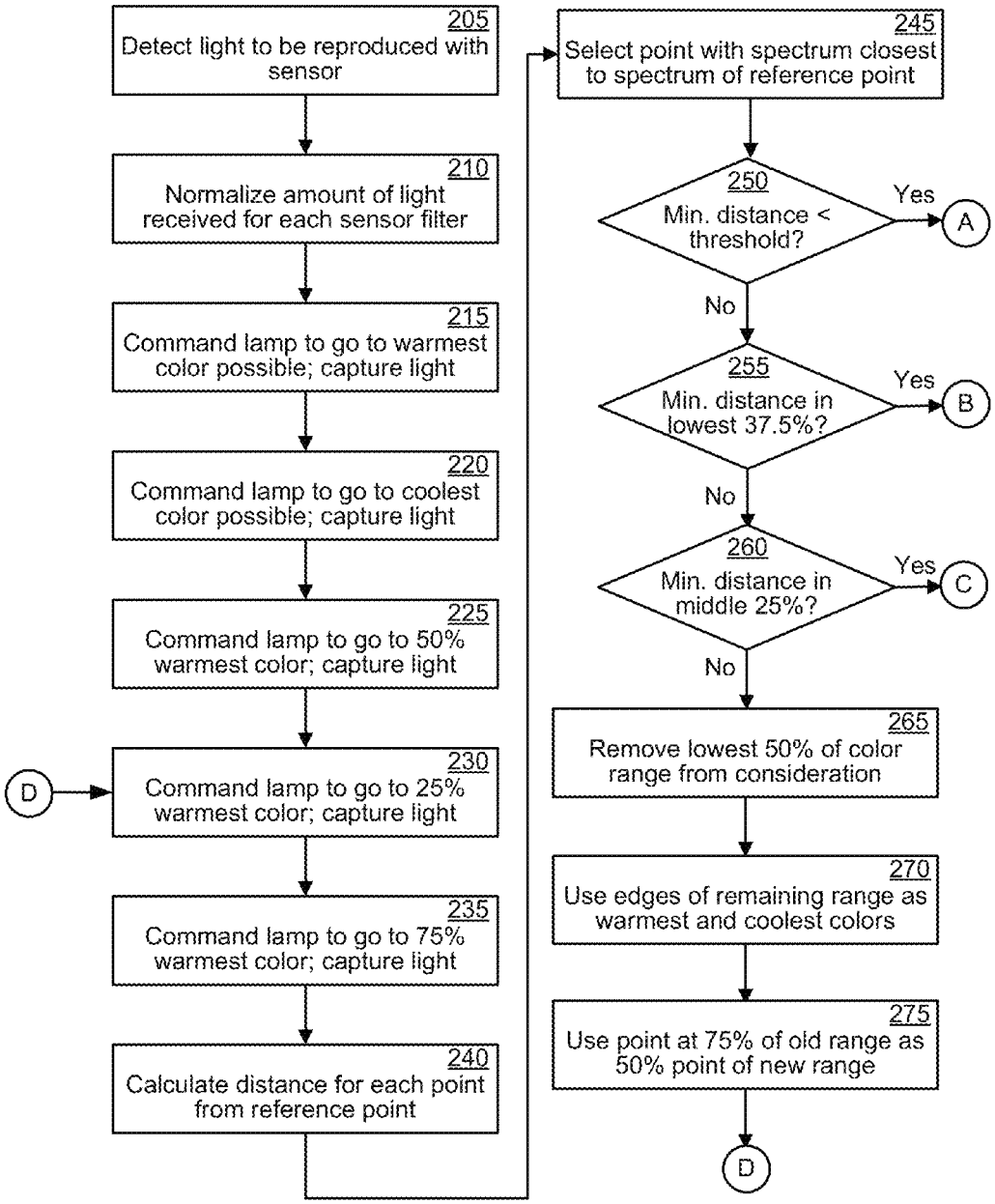
FIGS. 2A-2D is a flow diagram illustrating an example process of taking a sample of an existing light and reproducing the light with an LED-based lamp.
Figure 2B:
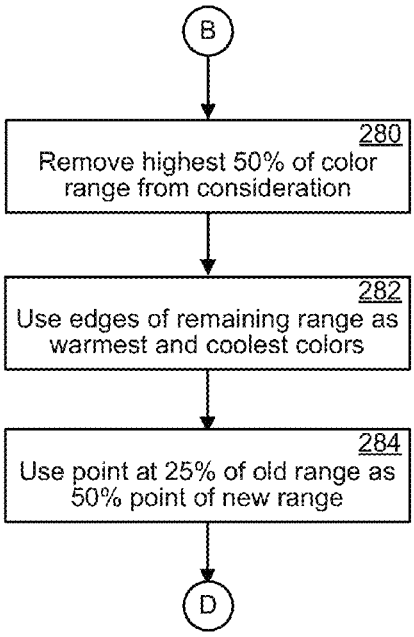
Figure 2C:
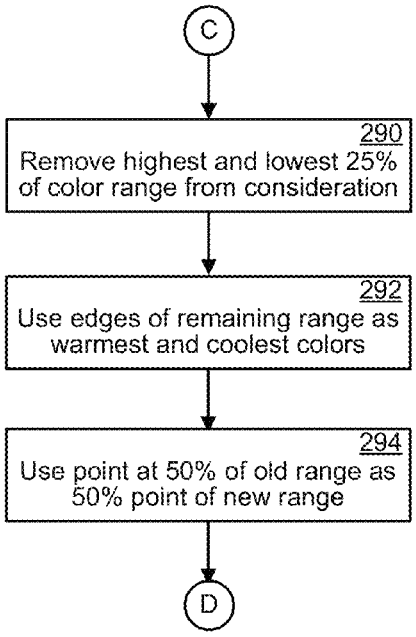
Figure 2D:
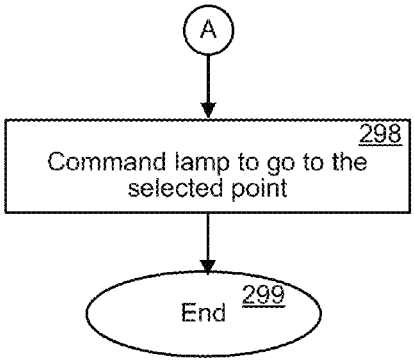

FIG. 1 shows a block diagram illustrating an example of an LED-based lamp or lighting node 110 and a controller 130 for the LED-based lamp or lighting node 110.

The LED-based lamp or lighting node 110 can include, for example, light source 112, communications module 114, processor 116, memory 118, and/or power supply 120. The controller 130 can include, for example, sensor 132, communications module 134, processor 136, memory 138, user interface 139, and/or power supply 140. Additional or fewer components can be included in the LED-based lamp 110 and the controller 130.

One embodiment of the LED-based lamp 110 includes light source 112. The light source 112 includes one or more LED strings, and each LED string can include one or more LEDs. In one embodiment, the LEDs in each LED string are configured to emit light having the same or substantially the same color. For example, the LEDs in each string can have the same peak wavelength within a given tolerance. In another embodiment, one or more of the LED strings can include LEDs with different colors that emit at different peak wavelengths or have different emission spectra. In some embodiments, the light source 112 can include sources of light that are not LEDs.

One embodiment of LED-based lamp 110 includes communications module 114. The LED-based lamp 110 communicates with the controller 130 through the communications module 114. In one embodiment, the communications module 114 communicates using radio frequency (RF) devices, for example, an analog or digital radio, a packet-based radio, an 802.11-based radio, a Bluetooth radio, or a wireless mesh network radio.

Because RF communications are not limited to line of sight, any LED-based lamp 110 that senses an RF command from the controller 130 will respond. Thurs, RF communications are useful for broadcasting commands to multiple LED-based lamps 110. However, if the controller needs to get a response from a particular lamp, each LED-based lamp 110 that communicates with the controller 130 should have a unique identification number or address so that the controller 130 can identify the particular LED-based lamp 110 that a command is intended for. The details regarding identifying individual lighting nodes can be found in U.S. patent application Ser. No. 12/782,038, entitled, "LAMP COLOR MATCHING AND CONTROL SYSTEMS AND METHODS" and is incorporated by reference.

Alternatively or additionally, the LED-based lamp 110 can communicate with the controller 130 using optical frequencies, such as with an IR transmitter and IR sensor or with a transmitter and receiver operates at any optical frequency. In one embodiment, the light source 112 can be used as the transmitter. A command sent using optical frequencies to a LED-based lamp 110 can come from anywhere in the room, so the optical receiver used by the LED-based lamp 110 should have a large receiving angle.

One embodiment of the LED-based lamp 110 includes processor 116. The processor 116 processes commands received from the controller 130 through the communications module 114 and responds to the controller's commands. For example, if the controller 130 commands the LED-based lamp 110 to calibrate the LED strings in the light source 112, the processor 116 runs the calibration routine as described in detail below. In one embodiment, the processor 116 responds to the controller's commands using a command protocol described below.

One embodiment of the LED-based lamp 110 includes memory 118. The memory stores a color model for the LED strings that are in the light source 112, where the color model includes information about the current level each LED string in the light source should be driven at to generate a particular CCT light output from the LED-based lamp 110. The memory 118 can also store filter values determined during a calibration process. In one embodiment, the memory 118 is non-volatile memory.

The light source 112 is powered by a power supply 120. In one embodiment, the power supply 120 is a battery. In some embodiments, the power supply 120 is coupled to an external power supply. The current delivered by the power supply to the LED strings in the light source 112 can be individually controlled by the processor 116 to provide the appropriate amounts of light at particular wavelengths to produce light having a particular CCT.

The controller 130 is used by a user to control the color and/or intensity of the light emitted by the LED-based lamp 110. One embodiment of the controller 130 includes sensor 132. The sensor 132 senses optical frequency wavelengths and converts the intensity of the light to a proportional electrical signal. The sensor can be implemented using, for example, one or more photodiodes, one or more photodetectors, a charge-coupled device (CCD) camera, or any other type of optical sensor.

One embodiment of the controller 130 includes communications module 134. The communications module 134 should be matched to communicate with the communications module 114 of the LED-based lamp 110. Thus, if the communications module 114 of the lamp 110 is configured to receive and/or transmit RF signals, the communications module 134 of the controller 130 should likewise be configured to transmit and/or receive RF signals. Similarly, if the communications module 114 of the lamp 110 is configured to receive and/or transmit optical signals, the communications module 134 of the controller 130 should likewise be configured to transmit and/or receive optical signals.

One embodiment of the controller 130 includes the processor 136. The processor 136 processes user commands received through the user interface 139 to control the LED-based lamp 110. The processor 136 also transmits to and receives communications from the LED-based lamp 110 for carrying out the user commands.

One embodiment of the controller 130 includes memory 138. The memory 138 may include but is not limited to, RAM, ROM, and any combination of volatile and non-volatile memory.

The controller 130 includes user interface 139. In one embodiment, the user interface 139 can be configured to be hardware-based. For example, the controller 130 can include buttons, sliders, switches, knobs, and any other hardware for directing the controller 130 to perform certain functions. Alternatively or additionally, the user interface 139 can be configured to be software-based. For example, the user interface hardware described above can be implemented using a software interface, and the controller can provide a graphical user interface for the user to interact with the controller 130.

The controller 130 is powered by a power supply 140. In one embodiment, the power supply 120 is a battery. In some embodiments, the power supply 120 is coupled to an external power supply.

Command Protocol

The controller 130 and the LED-based lamp 110 communicate using a closed loop command protocol. When the controller 130 sends a command, it expects a response from the LED-based lamp 110 to confirm that the command has been received. If the controller 130 does not receive a response, then the controller 130 will re-transmit the same command again. To ensure that the controller 130 receives a response to the appropriate corresponding command, each message that is sent between the controller 130 and the LED-based lamp 110 includes a message identification number.

The message identification number is part of a handshake protocol that ensures that each command generates one and only one action. For example, if the controller commands the lamp to increase intensity of an LED string by 5% and includes a message identification number, upon receiving the command, the lamp increases the intensity and sends a response to the controller acknowledging the command with the same message identification number. If the controller does not receive the response, the controller resends the command with the same message identification number. Upon receiving the command a second time, the lamp will not increase the intensity again but will send a second response to the controller acknowledging the command along with the message identification number. The message identification number is incremented each time a new command is sent.

Color Model

The LED strings in the LED-based lamp 110 are characterized to develop a color model that is used by the LED-based lamp 110 to generate light having a certain CCT. The color model is stored in memory at the lamp. In one embodiment, the color model is in the format of an array that includes information on how much luminous flux each LED string should generate in order to produce a total light output having a specific CCT. For example, if the user desires to go to a CCT of 3500° K., and the LED-based lamp 110 includes four color LED strings, white, red, blue, and amber, the array can be configured to provide information as to the percentage of possible output power each of the four LED strings should be driven at to generate light having a range of CCT values.

The array includes entries for the current levels for driving each LED string for CCT values that are along or near the Planckian locus. The Planckian locus is a line or region in a chromaticity diagram away from which a CCT measurement ceases to be meaningful. Limiting the CCT values that the LED-based lamp 110 generates to along or near the Planckian locus avoids driving the LED strings of the LED-based lamp 110 in combinations that do not provide effective lighting solutions.

The array can include any number of CCT value entries, for example, 256. If the LED-based lamp 110 receives a command from the controller 130 to generate, for example, the warmest color that the lamp can produce, the LED-based lamp 110 will look up the color model array in memory and find the amount of current needed to drive each of its LED strings corresponding to the lowest CCT in its color model. For an array having 256 entries from 1 to 256, the warmest color would correspond to entry 1. Likewise, if the command is to generate the coolest color that the lamp can produce, the LED-based lamp 110 will look up in the color model the amount of current needed to drive the LED strings corresponding to the highest CCT. For an array having 256 entries from 1 to 256, the coolest color would correspond to entry 256. If the command specifies a percentage point within the operating range of the lamp, for example 50%, the LED-based lamp 110 will find 50% of its maximum range of values in the array (256) and go to the current values for the LED strings corresponding to point 128 within the array.

'Copying and Pasting' an Existing Light

FIGS. 2A-2D is a flow diagram illustrating an example process of taking a sample of an existing light and reproducing the light with an LED-based lamp.

At block 205, when the user aims the sensor on the controller toward the light to be reproduced, the sensor detects the light and generates an electrical signal that is proportional to the intensity of the detected light. In one embodiment, multiple samples of the light are taken and averaged together to obtain a CCT reference point. The CCT reference point will be compared to the CCT of light emitted by the LED-based lamp in this process until the lamp reproduces the CCT of the reference point to within an acceptable tolerance.

Because the light generated by the LED-based lamp 110 is restricted to CCT values along the Planckian locus, reproducing the spectrum of the reference point is essential a one-dimensional search for a CCT value along the Planckian locus that matches the CCT of the reference light to be reproduced.

One or more sensors can be used to capture the light to be reproduced. The analysis and reproduction of the spectrum of the reference point are enabled when the one or more sensors can provide information corresponding to light intensity values in more than one band of wavelengths. Information relating to a band of wavelengths can be obtained by using a bandpass filter over different portions of the sensor, provided that each portion of the sensor receives a substantially similar amount of light. In one embodiment, a Taos 3414CS RGB color sensor is used. The Taos sensor has an 8×2 array of filtered photodiodes. Four of the photodiodes have red bandpass filters, four have green bandpass filters, four have blue bandpass filters, and four use no bandpass filter, i.e. a clear filter. The Taos sensor provides an average value for the light intensity received at four the photodiodes within each of the four groups of filtered (or unfiltered) photodiodes. For example, the light received by the red filtered photodiodes provides a value R, the light received by the green photodiodes provides a value G, the light received by the blue filtered photodiodes provides a value B, and the light received by the unfiltered photodiodes provides a value U.

The unfiltered value U includes light that has been measured and included in the other filtered values R, G, and B. The unfiltered value U can be adjusted to de-emphasize the light represented by the filtered values R, G, and B by subtracting a portion of their contribution from U. In one embodiment, the adjusted value U' is taken to be U−(R+G+B)/3.

At block 210, the processor in the controller normalizes the received values for each filtered (or unfiltered) photodiode group of the reference point by dividing each of the values by the sum of the four values (R+G+B+U'). Thus, for example, for the Taos sensor, the normalized red light is $C_{RR}$=R/(R+G+B+U'), the normalized green light is $C_{RG}$=G/(R+G+B+U'), the normalized blue light is $C_{RB}$=B/(R+G+B+U'), and the normalized unfiltered light is $C_{RU}$=U'/(R+G+B+U'). By normalizing the values received for each filtered or unfiltered photodiode group, the values are independent of the distance of the light source to the sensor.

Then at block 215, the controller commands the lamp to go to the coolest color (referred to herein as 100% of the operating range of the lamp) possible according to the color model stored in memory in the lamp. When the lamp has produced the coolest color possible, the lamp sends a signal to the controller, and the controller captures a sample of the light emitted by the lamp. Similar to the reference point, multiple samples can be taken and averaged, and the averaged values provided by the sensor for the 100% point are normalized as was done with the reference point and then stored.

At block 220, the controller commands the lamp to go to the warmest color (referred to herein as 0% of the operating range of the lamp) according to the color model stored in memory in the lamp. When the lamp has produced the warmest color possible, the lamp sends a signal to the controller, and the controller captures a sample of the light emitted by the lamp. Similar to the reference point, multiple samples can be taken and averaged, and the averaged values provided by the sensor for the 0% point are normalized as was done with the reference point and then stored.

At block 225, the controller commands the lamp to go to the middle of the operating range (referred to herein as 50% of the operating range of the lamp) according to the color model stored in memory in the lamp. When the lamp has produced the color in the middle of the operating range, the lamp sends a signal to the controller, and the controller captures a sample of the light emitted by the lamp. Similar to the reference point, multiple samples can be taken and averaged, and averaged the values provided by the sensor for the 50% point are normalized as was done with the reference point and then stored.

At block 230, the controller commands the lamp to produce light output corresponding to the point at 25% of the operating range of the lamp according to the color model stored in memory in the lamp. When the lamp has produced the requested color, the lamp sends a signal to the controller, and the controller captures a sample of the light emitted by the lamp. Similar to the reference point, multiple samples can be taken and averaged, and the averaged values provided by the sensor for the 25% point are normalized as was done with the reference point and then stored.

At block 235, the controller commands the lamp to produce light output corresponding to the point at 75% of the operating range of the lamp according to the color model stored in memory in the lamp. When the lamp has produced the requested color, the lamp sends a signal to the controller, and the controller captures a sample of the light emitted by the lamp. Similar to the reference point, multiple samples can be taken and averaged, and the averaged values provided by the sensor for the 75% point are normalized as was done with the reference point and then stored.

Figure 3A:
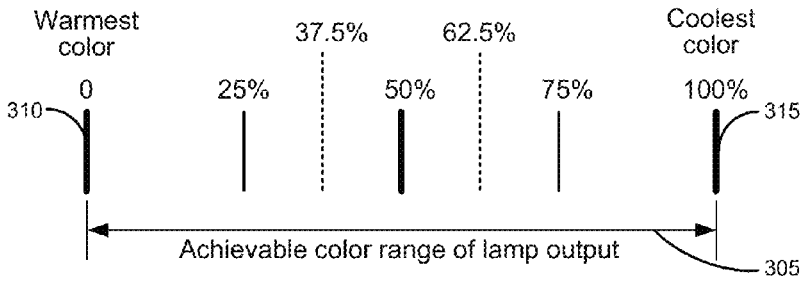
FIGS. 3A-3D depict various example lighting situations that may be encountered by the CCT reproduction algorithm.

The five light samples generated by the LED-based lamp at blocks 215-235 correspond to the 0%, 25%, 50%, 75%, and 100% points of the operating range of the lamp. The achievable color range 305 of the LED-based lamp is shown conceptually in FIG. 3A along with the relative locations of the five sample points. The left end of range 305 is the 0% point 310 of the operating range and corresponds to the warmest color that the lamp can, while the right end of range 305 is the 100% point 315 of the operating range and corresponds to the coolest color that the lamp can produce. Because the color model stored in the memory of the lamp provides information on how to produce an output CCT that is on or near the Planckian locus, the achievable color range 305 is limited to on or near the Planckian locus. A person of skill in the art will recognize that greater than five or fewer than five sample points can be taken and that the points can be taken at other points within the operating range of the lamp.

Then at block 240, the controller processor calculates the relative 'distance' for each of the five light samples from the reference point, that is, the processor quantitatively determines how close the spectra of the light samples are to the spectrum of the reference point. The processor uses the formula $$\sum_x \left[\frac{C_{Sx}}{C_{Rx}} - \frac{C_{Rx}}{C_{Sx}}\right]^2$$

to quantify the distance, where the summation is over the different filtered and unfiltered photodiode groups, and x refers to the particular filtered photodiode group (i.e., red, green, blue, or clear); $C_{Sx}$ is the normalized value for one of the filtered (or unfiltered) photodiode groups of a light sample generated by the LED-based lamp; and $C_{Rx}$ is the normalized value for the reference point of the filtered (or unfiltered) photodiode groups. Essentially, the lighting system comprising the controller 130 and LED-based lamp 110 tries to find an operating point of the lamp that minimizes the value provided by this equation. This particular equation is useful because the approach to the reference point is symmetrical for spectral contributions greater than the reference point and for spectral contributions less than the reference point. A person of skill in the art will recognize that many other equations can also be used to determine a relative distance between spectral values.

The sample point having a spectrum closest to the reference point spectrum is selected at block 245 by the controller processor. At decision block 250, the controller processor determines whether the distance calculated for the selected sample point is less than a particular threshold. The threshold is set to ensure a minimum accuracy of the reproduced spectrum. In one embodiment, the threshold can be based upon a predetermined confidence interval. The lower the specified threshold, the closer the reproduced spectrum will be to the spectrum of the reference point. If the distance is less than the threshold (block 250—Yes), at block 298 the controller processor directs the lamp to go to the selected point. The process ends at block 299.

If the distance is not less than the threshold (block 250—No), the controller processor removes half of the operating range (search space) from consideration and selects two new test points for the lamp to produce. At decision block 255 the controller processor determines whether the selected point is within the lowest 37.5% of the color operating range of the lamp. If the point is within the lowest 37.5% of the color operating range of the lamp (block 255—Yes), at block 280 the controller processor removes the highest 50% of the operating color range from consideration. It should be noted that by removing half of the operating color range from consideration, the search space for the CCT substantially matching the CCT of the light to be reproduced is reduced by half, as is typical with a binary search algorithm. Further, a buffer zone (12.5% in this example) is provided between the range in which the selected is located and the portion of the operating range that is removed from consideration. The buffer zone allows a margin for error to accommodate any uncertainty that may be related to the sensor readings.

Figure 3B:
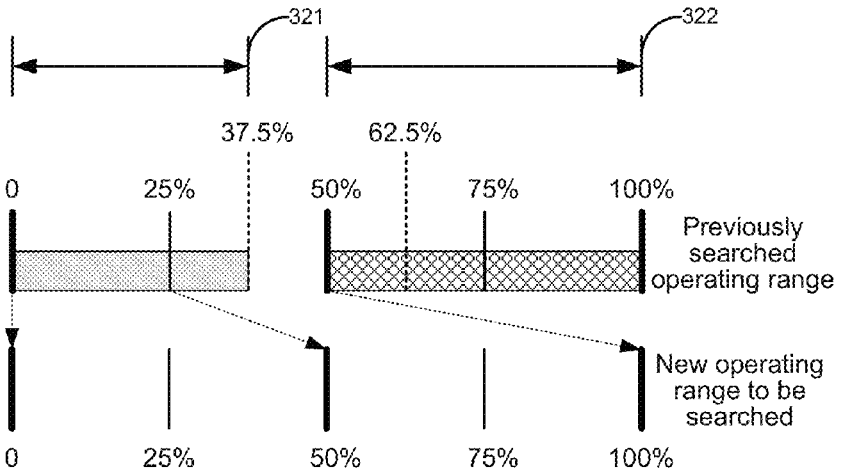

FIG. 3B depicts the originally considered operating range (top range) relative to the new operating range to be searched (bottom range) for the particular case where the selected point is within the portion 321 of the operating range between 0 and 37.5% (grey area). In this case, the portion 322 of the operating range between 50% and 100% (cross-hatched) is removed from consideration. The portion between portions 321 and 322 provides a safety margin for any errors in the sensor readings.

Then at block 282, the controller processor uses the edges of the remaining operating color range as the warmest and coolest colors, and at block 284, the 25% point of the previous color range is used as the 50% point of the new color range. The new operating range is shown relative to the old operating range by the arrows in FIG. 3B. The process returns to block 230 and continues.

If the point is not within the lowest 37.5% of the color operating range of the lamp (block 255—No), at decision block 260 the controller processor determines whether the selected point is within the middle 25% of the color operating range of the lamp. If the point is within the middle 25% of the color operating range of the lamp (block 255—Yes), at block 290 the controller processor removes the highest and lowest 25% of the operating color range from consideration.

Figure 3C:
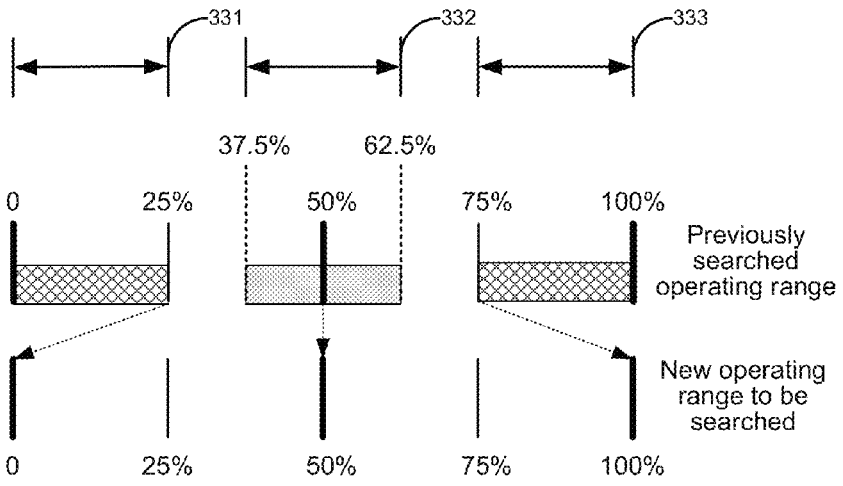

FIG. 3C depicts the originally considered operating range (top range) relative to the new operating range to be searched (bottom range) for the particular case where the selected point is within the portion 332 of the operating range between 37.5 and 62.5% (grey area). In this case, the portions 331, 333 of the operating range between 0% and 25% and between 75% and 100% (cross-hatched) are removed from consideration. The portion between 331 and 332 and the portion between 332 and 333 provide safety margins for any errors in the sensor readings.

Then at block 292, the controller processor uses the edges of the remaining operating color range as the warmest and coolest colors, and at block 294, the 50% point of the previous color range is used as the 50% point of the new color range. The new operating range is shown relative to the old operating range by the arrows in FIG. 3C. The process returns to block 230 and continues.

If the point is not within the middle 25% of the color operating range of the lamp (block 255—No), at block 265 the controller processor removes the lowest 50% of the operating color range from consideration.

Figure 3D:
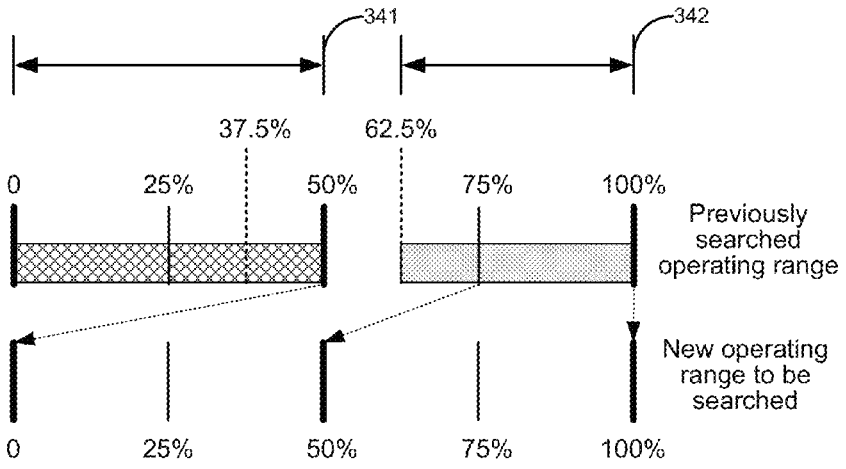

FIG. 3D depicts the originally considered operating range (top range) relative to the new operating range to be searched (bottom range) for the particular case where the selected point is within the portion 342 of the operating range between 62.5% and 100% (grey area). In this case, the portion 341 of the operating range between 0% and 50% (cross-hatched) is removed from consideration. The portion between portions 341 and 342 provides a safety margin for any errors in the sensor readings.

Then at block 270, the controller processor uses the edges of the remaining operating color range as the warmest and coolest colors, and at block 272, the 75% point of the previous color range is used as the 50% point of the new color range. The new operating range is shown relative to the old operating range by the arrows in FIG. 3D. The process returns to block 230 and continues.

Additionally, in one embodiment, every time the controller 130 commands the lamp 110 to go to a certain point in its operating range, the lamp responds by providing the CCT value corresponding to the requested point as stored in the lamp's memory. Then the controller 130 will know the CCT being generated by the lamp 110.

The process iterates the narrowing of the operating range until the LED-based lamp generates a light having a spectrum sufficiently close to the spectrum of the reference point. However, for each subsequent iteration, only two new sample points need to be generated and tested, rather than five. Narrowing the operating range of the lamp essentially performs a one-dimensional search along the Planckian locus.

A person skilled in the art will realize that a different number of sample points in different locations of the operating range can be taken, and a different percentage or different portions of the operating range can be removed from consideration.

Calibration of the LED Strings

Figure 4:
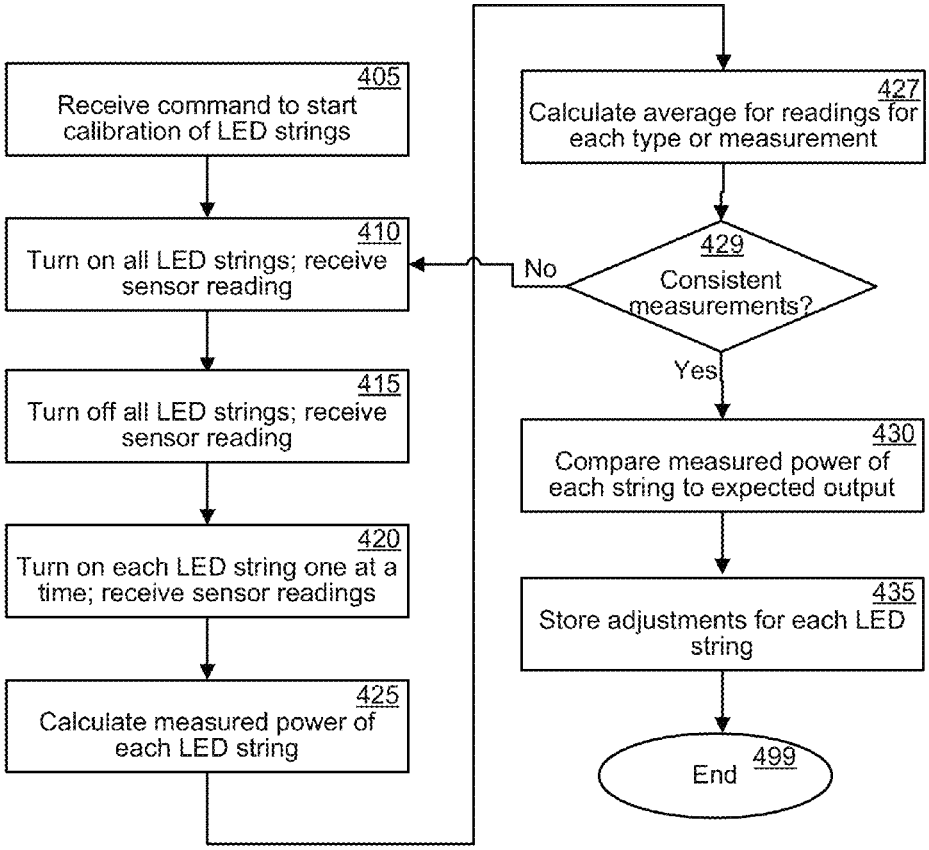
FIG. 4 is a flow diagram illustrating an example process of calibrating an LED-based lamp.

FIG. 4 is a flow diagram illustrating an example process of calibrating an LED-based lamp. The overall CCT of the light generated by the LED-based lamp 110 is sensitive to the relative amount of light provided by the different color LED strings. As an LED ages, the output power of the LED decreases for the same driving current. Thus, it is important to know how much an LEDs output power has deteriorated over time. By calibrating the LED strings in the lamp 110, the lamp 110 can proportionately decrease the output power from the other LED strings to maintain the appropriate CCT of its output light. Alternatively, the lamp 110 can increase the driving current to the LED string to maintain the appropriate amount of light output from the LED string to maintain the appropriate CCT level.

At block 405, the lamp 110 receives a command from the controller 130 to start calibration of the LED strings. The command is received by the communications module 114 in the lamp. In one embodiment, the lamp 110 may be programmed to wait a predetermined amount of time to allow the user to place the controller 130 in a stable location and to aim the sensor at the lamp 110.

After receiving the calibration command, the lamp 110 performs the calibration process, and the controller 130 merely provides measurement information regarding the light generated by the lamp 110. Typically, the power output of an LED driven at a given current will decrease as the LED ages, while the peak wavelength does not drift substantially. Thus, although the sensor 132 in the controller 130 can have different filtered photodiodes, as discussed above, only the unfiltered or clear filtered photodiodes are used to provide feedback to the lamp 110 during the calibration process.

Then at block 410 the lamp turns on all of its LED strings. All of the LED strings are turned on to determine how many lumens of light are being generated by all the LED strings. The LED strings are driven by a current level that at the factory corresponded to an output of 100% power.

When the lamp has finished turning on all the LED strings, the lamp sends the controller a message to capture the light and transmit the sensor readings back. The lamp receives the sensor readings through the transceiver.

Next, at block 415 the lamp turns off all of its LED strings. When the lamp has finished turning off all the LED strings, the lamp sends the controller a message to capture the light and transmit the sensor readings back. The lamp receives the sensor readings through the transceiver. This reading is a reading of the ambient light that can be zeroed out during the calibration calculations.

At block 420 the lamp turns on each of its LED strings one at a time at a predetermined current level as used at block 410, as specified by the calibration table stored in memory in the lamp. After the lamp has finished turning on each of its LED strings, the lamp sends the controller a message to capture the light and transmit the sensor readings back. The lamp receives the sensor readings corresponding to each LED string through the transceiver.

Then at block 425 the lamp processor calculates the measured power of each LED string using the sensor readings. An example scenario is summarized in a table in FIG. 5 for the case where there are three different colored LED strings in the lamp, for example white, red, and blue. In one embodiment, only LEDs having the same color or similar peak wavelengths are placed in the same LED string, for example red LEDs or white LEDs. Measurement A is taken when all three strings are on. Measurement B is taken when all three strings are off so that only ambient light is measured. Measurement C is taken when LED string 1 is on, and LED strings 2 and 3 are off. Measurement D is taken when LED string 2 is on and LED strings 1 and 3 are off. Measurement E is taken when LED string 3 is on and LED strings 1 and 2 are off. Measurement F is taken when LED string 3 is off and LED strings 1 and 2 are on. Measurement G is taken when LED string 2 is off and LED strings 1 and 3 are on. Measurement H is taken when LED string 1 is off and LED strings 2 and 3 are on. The output power of LED string 1 equals (A−B+C−D−E+F+G−H). The output power of LED string 2 equals (A−B−C+D−E+F−G+H). The output power of LED string 3 equals (A−B−C−D+E−F+G+H).

At block 427, the lamp processor calculates an average and standard deviation over all measurements taken for each type of measurement (all LED strings on, all LED strings off, and each LED string on individually).

Then at decision block 429, the lamp processor determines if a sufficient number of data points have been recorded. Multiple data points should be taken and averaged in case a particular measurement was wrong or the ambient light changes or the lamp heats up. If only one set of readings have been taken or the averaged measurements are not consistent such that the fluctuations in the power measurements are greater than a threshold value (block 429—No), the process returns to block 410.

If the averaged measurements are consistent (block 429—Yes), at block 430 the normalized averaged output power of each LED string calculated at block 427 is compared by the lamp processor to the normalized expected power output of that particular LED string stored in the lamp memory. A normalized average output power of each LED string is calculated based on the average output power of each LED string over the average total output power of all of the LED strings. Similarly the normalized expected power output of a LED string is the expected power output of the LED string over the total expected power output of all of the LED strings. A ratio of the calculated output power to the expected output power can be used to determine which LED strings have experienced the most luminance degradation, and the output power form the other LED strings are reduced by that ratio to maintain the same proportion of output power from the lamp to maintain a given CCT. And if other LED strings have also degraded, the total reduction factor can take all of the degradation factors into account. For example, consider the case where string 1 degraded so that it can only provide 80% of its expected output power, string 2 degraded so that it can only provide 90% of its expected output power, and string 3 did not degrade so that it still provides 100% of its expected output power. Then because string 1 degraded the most, all of the other strings should reduce their output power proportionately to maintain the same ratio of contribution from each LED string. In this case, string 1 is still required to provide 100% (factor of 1.0) of its maximum output, while string 2 is required to provide a factor of 0.8/0.9=0.889 of its maximum output, and string 3 is required to provide a factor of 0.8 of its maximum power output. This process ensures that the ratios of the output powers of all the LED strings is constant, thus maintaining the same CCT, even though the intensity is lower.

Alternatively, a ratio of the calculated output power to the expected output power can be used to determine whether a higher current should be applied to the LED string to generate the expected output power. The ratios are stored in the lamp memory at block 435 for use in adjusting the current levels applied to each LED string to ensure that the same expected output power is obtained from each LED string. The process ends at block 499.

Expert System for Developing a Color Model for an LED-Based Lamp

The color model that is developed for the LED-based lamp 110 is particular to the LEDs used in the particular LED-based lamp 110 and based upon experimental data rather than a theoretical model that uses information provided by manufacturer data sheets. For example, a batch of binned LEDs received from a manufacturer is supposed to have LEDs that emit at the same or nearly the same peak wavelengths.

A color model is developed experimentally for an LED-based lamp 110 by using a spectrum analyzer to measure the change in the spectrum of the combined output of the LED strings in the lamp. While the manufacturer of LEDs may provide a data sheet for each bin of LEDs, the LEDs in a bin can still vary in their peak wavelength and in the produced light intensity (lumens per watt of input power or lumens per driving current). If even a single LED has a peak wavelength or intensity variation, the resulting lamp CCT can be effected, thus the other LED strings require adjustment to compensate for the variation of that LED. The LEDs are tested to confirm their spectral peaks and to determine how hard to drive a string of the LEDs to get a range of output power levels.

Ultimately, multiple different color LED strings are used together in a lamp to generate light with a tunable CCT. The CCT is tuned by appropriately varying the output power level of each of the LED strings. Also, there are many different interactions among the LED strings that should be accounted for when developing a color model. Some interactions may have a larger effect than other interactions, and the interactions are dependent upon the desired CCT. For example, if the desired CCT is in the lower range, variation in the red LED string will have a large effect.

Figure 6A:
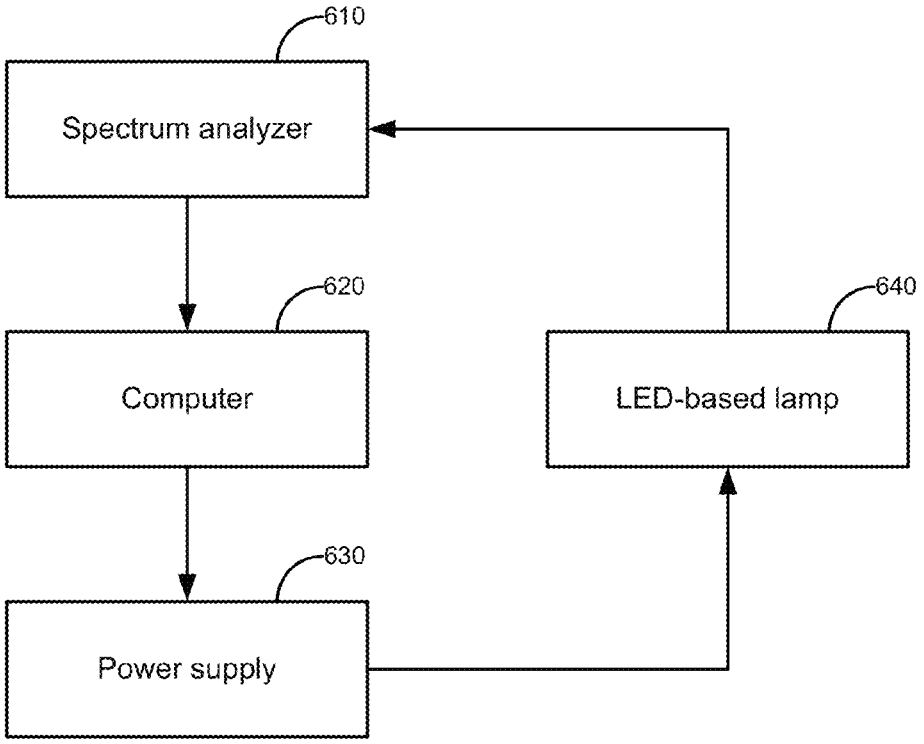
FIG. 6A shows a block diagram illustrating an example closed loop system that uses an expert system to develop a color model for an LED-based lamp.

While a person's eyes are sensitive and well-suited to identifying subtle color changes, developing a color model can be time consuming given that minor changes in the output power of a single LED string can have a noticeable effect on the CCT of the overall light generated by the lamp. When multiple LED strings are driven simultaneously, the task of developing a color model becomes even more complex. It would be advantageous to have an automated system develop the color model. FIG. 6 shows a block diagram illustrating an example closed loop system that uses an expert system 650 to develop a color model for an LED-based lamp. The system includes a computer 620, a spectrum analyzer 610, a pulse width modulation (PWM) controller 625, a power supply 630, and a lamp 640 for which a color model is to be developed.

Figure 6B:
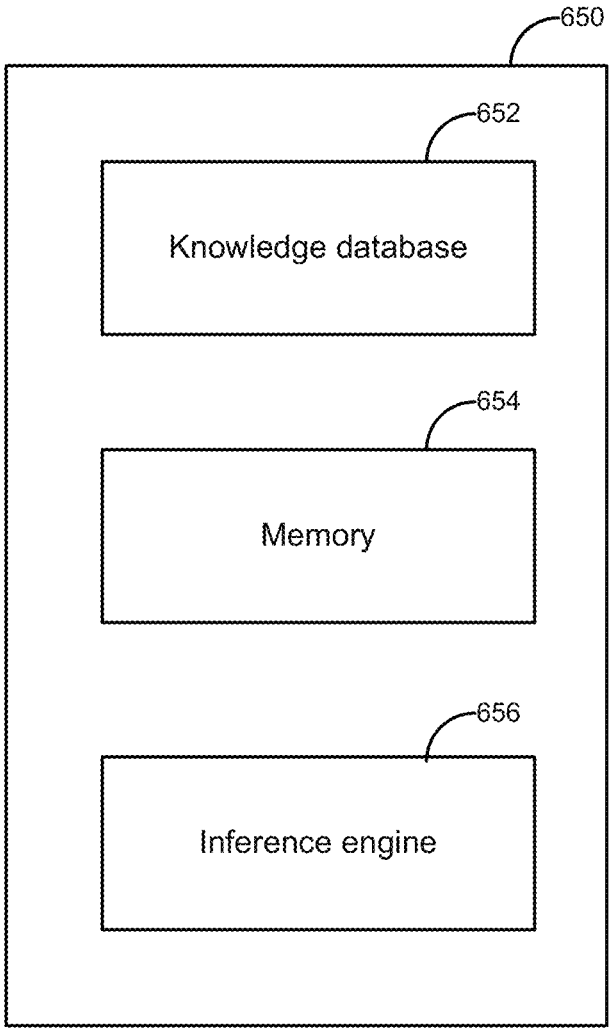
FIG. 6B shows a block diagram illustrating an example of an expert system that can be used to generate a color model for an LED-based lamp

The lamp 640 has multiple LED strings, and each LED string can include LEDs with the same or different peak wavelength or emission spectrum. The spectrum analyzer 610 monitors the output of the lamp 640 and provides spectral information of the emitted light to the computer 620. The computer 620 includes the expert system 650, as shown in FIG. 6B, for analyzing the received spectral information in conjunction with the known LED string colors and target CCT values. The computer 620 can control a power supply 630 that supplies driving current to each of the LED strings in the lamp 640. For example, the computer 620 can control the power supply 630 via the PWM controller. Alternatively, the computer 620 can control the power supply 630 directly. The current to each of the LED strings can be controlled individually by the computer 620. The expert system can include a knowledge database 652, a memory 654, and an inference engine 656.

The knowledge database 652 stores information relating particularly to LEDs, current levels for driving LEDs, color and CCT values, and variations in overall CCT given changes in contribution of colors. For example, if the desired CCT is in the lower range, variation in the red LED string will have a large effect. The information stored in the knowledge database 652 is obtained from a person skilled with using LEDs to generate light having a range of CCTs.

The inference engine 656 analyzes the spectra of the light generated by the lamp in conjunction with the driving current levels of the LED strings and the information in the knowledge database 652 to make a decision on how to adjust the driving current levels to move closer to obtaining a particular CCT. The inference engine 656 can store tested current values and corresponding measured spectra in working memory 624 while developing the color model.

In one embodiment, artificial intelligence software, such as machine learning, can be used to develop algorithms for the inference engine 656 to use in generating a color model from the measured spectra and LED driving current levels. Examples of known color model data can be provided to the inference engine 656 through the knowledge database 652 to teach the inference engine 656 to recognize patterns in changes to the spectrum of the generated light based upon changes to LED driving current levels. The known examples can help the inference engine 656 to make intelligent decisions based on experimental data provided for a lamp to be modeled. In one embodiment, the knowledge database 652 can also include examples of how certain changes in driving current to certain color LED strings adversely affect the intended change in CCT of the light generated by the lamp.

In one embodiment, once a color model has been developed by the expert system 650, a human can review the color model and make adjustments, if necessary.

In one embodiment, one or more custom color models can be developed and stored in the lamp. For example, if a customer wants to optimize the color model for intensity of the light where the quality of the generated light is not as important as the intensity, a custom color model can be developed for the lamp that just produces light in a desired color range but provides a high light intensity. Or if a customer wants a really high quality of light where the color is important, but the total intensity is not, a different color model can be developed. Different models can be developed by changing the amount of light generated by each of the different color LED strings in the lamp. These models can also be developed by the expert system.

Essentially, the color model is made up of an array of multiplicative factors that quantify how hard each LED string should be driven to achieve a certain CCT for the lamp output. Once a color model for the LED strings in a lamp has been developed, it is stored in a memory in that lamp. The color model can be adjusted or updated remotely by the controller. Additionally, new custom color models can be developed and uploaded to the lamp at any point in the life of the lamp.

Smart Phone Interface

In one embodiment, the controller user interface 139 can be implemented as a graphical user interface (GUI) on a smart phone so that a user can provide commands to the LED-based lamp 110 through the smart phone rather than, or in addition to, the controller 130. Four example configurations using the smart phone GUI are shown in FIGS. 7A-7E. The smart phone 700 is shown in FIG. 7A with a communications port 702.

In the example configuration shown in FIG. 7B, the controller 710 couples to the smart phone communications port 702 through a cable 712. The controller 710 functions as described above, including monitoring the light emitted by the LED-based lamp 110 with sensor 132 (not shown).

Figure 8A:
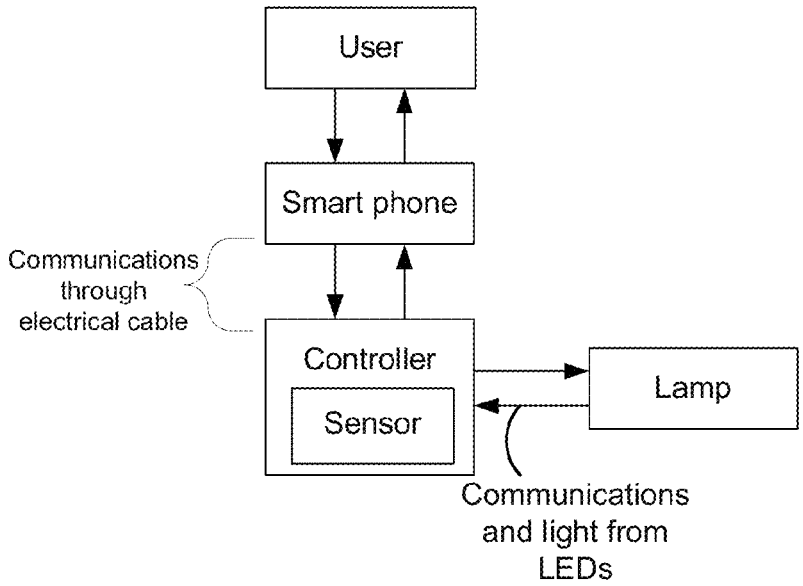
FIGS. 8A-8D show block diagrams illustrating communications within a lighting system for various example configurations using a smart phone for a user interface.

FIG. 8A shows a block diagram illustrating communications within the lighting system that implements the configuration shown in FIG. 7B. The user sends commands to and receives information from the smart phone through the GUI. The smart phone communicates with the controller through the electrical cable coupling the two units. The controller has a sensor for sensing the light emitted by the lamp. Further, the controller and the lamp transmit and receive commands and response to commands, either using RF or optical methods, as described above.

The user interface (UI) 139 includes a way to select a particular lamp to be controlled, for example, from a list of lamps that may be ordered by identification number, location, user preference, cycling through available lamps, or using any other method of presentation of the lamps. For the configuration shown in FIG. 7B, the UI can also include a button to push for capturing a target light impinging on a sensor in the controller 710 for copying the target light for reproduction by the selected lamp. The smart phone transmits the capture command to the controller 710 through the cable 712. Once the target light has been captured by the controller sensor, the controller communicates with the selected lamp to execute the process shown in FIGS. 2A-2D above for finding the operating point of the lamp that generates light that reproduces the target light.

The UI can also include a way for the user to initiate calibration of the selected lamp. When the smart phone receives the initiate calibration command, it again transmits the calibration command to the controller 710 through the cable 712. The controller then communicates with the selected lamp to perform the calibration process shown in FIG. 4 above.

In the example configuration shown in FIG. 7C, an adapter 720 with an optical sensor 724 has a port 722 configured to allow it to directly couple to communications port 702 on the smart phone 700.

Figure 8B:
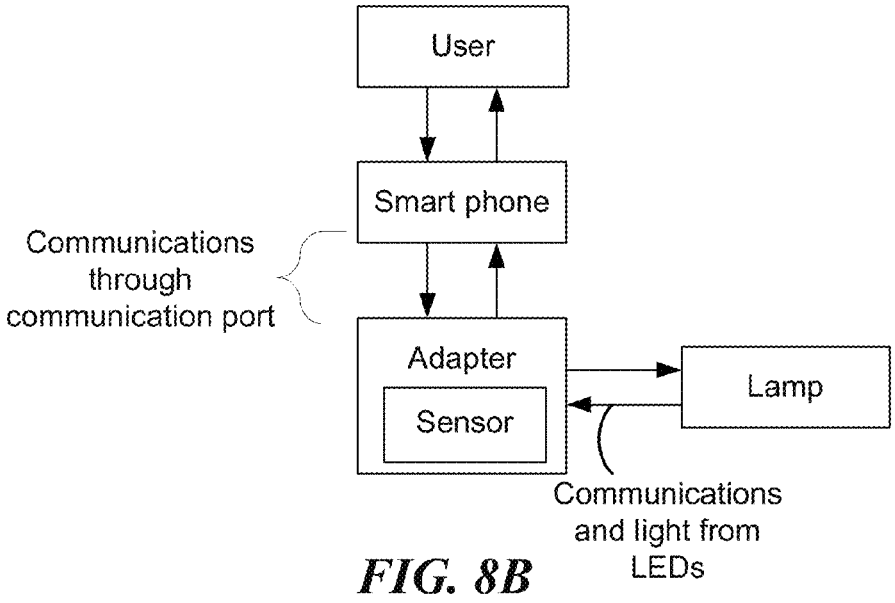

FIG. 8B shows a block diagram illustrating communications within the lighting system that implements the configuration shown in FIG. 7C. The user sends commands to and receives information from the smart phone through the GUI. The adapter is directly connected to the communications port of the smart phone, and communications between the smart phone and the adapter pass through the communications port. The adapter has a sensor for sensing the light emitted by the lamp. Further, the adapter and the lamp transmit and receive commands and responses to commands, either using RF or optical methods, as described above.

For the configuration shown in FIG. 7C, the UI can also include a button to push for capturing a target light impinging on a sensor in the adapter 720 for copying the target light for reproduction by the selected lamp. The smart phone transmits the capture command to the adapter 720 via the communications port 702. Once the target light has been captured by the adapter sensor, the adapter 720 communicates with the selected lamp to execute the process shown in FIGS. 2A-2D above for finding the operating point of the lamp that generates light that reproduces the target light.

The UI can also include a way for the user to initiate calibration of the selected lamp. When the smart phone receives the initiate calibration command, it again transmits the calibration command to the adapter 720 through the communications port 702. The adapter 720 then communicates with the selected lamp to perform the calibration process shown in FIG. 4 above.

In the example configuration shown in FIG. 7D, an adapter 730 without an optical sensor has a port 732 configured to allow it to directly couple to communications port 702 on the smart phone 700.

Figure 8C:
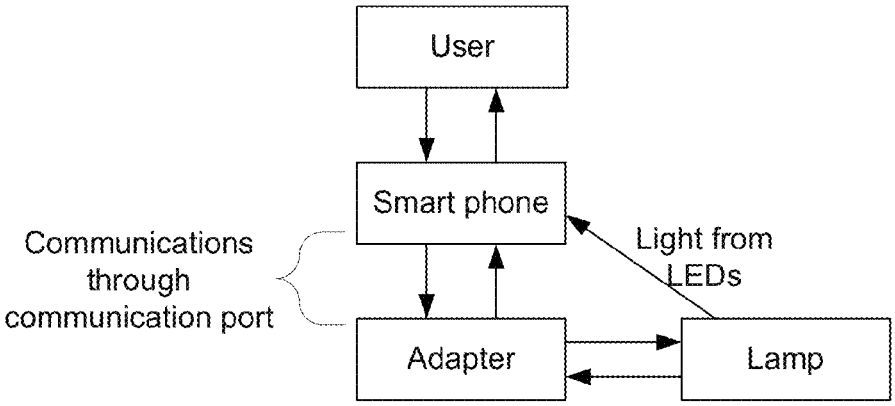

FIG. 8C shows a block diagram illustrating communications within the lighting system that implements the configuration shown in FIG. 7D. The user sends commands to and receives information from the smart phone through the GUI. The adapter is directly connected to the communications port of the smart phone, and communications between the smart phone and the adapter 730 pass through the communications port 702. The smart phone uses its camera for sensing light emitted by the lamp. In one embodiment, the zoom capability of the smart phone camera can be used to aim the camera sensor at the lamp to be controlled. Further, the adapter and the lamp transmit and receive commands and responses to commands, either using RF or optical methods, as described above.

For the configuration shown in FIG. 7D, the UI can also include a button to push for capturing a target light impinging on a sensor, e.g. the imaging sensor in the camera, in the smart phone 700 for copying the target light for reproduction by the selected lamp. The smart phone captures the light. Once the target light has been captured by the smart phone sensor, the smart phone sends the captured light information to the adapter 730 through the communications port 702. The adapter 730 communicates with the selected lamp to execute the process shown in FIGS. 2A-2D above for finding the operating point of the lamp that generates light that reproduces the target light.

The UI can also include a way for the user to initiate calibration of the selected lamp. When the smart phone receives the initiate calibration command, it transmits the calibration command to the adapter 730 through the communications port 702. The adapter 730 then communicates with the selected lamp to perform the calibration process shown in FIG. 4 above.

In the example configuration shown in FIG. 7E, a wireless controller 740 communicates wirelessly with the smart phone 700 and the LED-based lamp 110. In one embodiment, the wireless controller operates using Bluetooth.

Figure 8D:
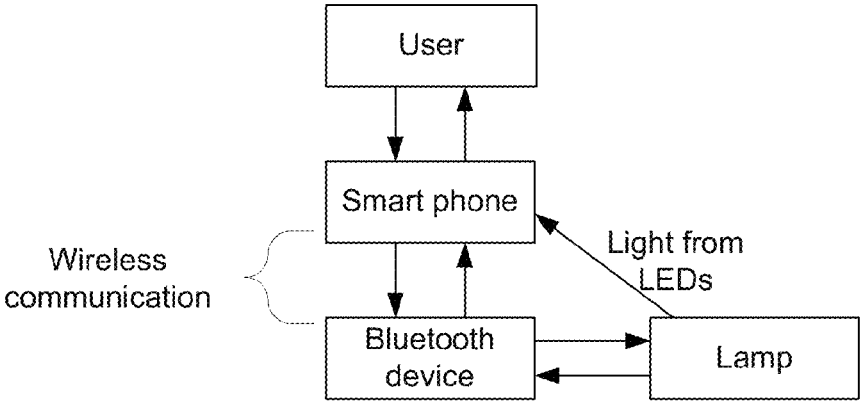

FIG. 8D shows a block diagram illustrating communications within the lighting system that implements the configuration shown in FIG. 7E. The user sends commands to and receives information from the smart phone through the GUI. The wireless controller 740 communicates wirelessly with the smart phone. The smart phone uses its camera for sensing light emitted by the lamp. Further, the wireless controller 740 and the lamp transmit and receive commands and responses to commands using RF methods, as described above. The advantage to using the wireless controller 740 is that it can be permanently mounted somewhere in the same room as the lamp(s) to be controlled, for example, on the ceiling.

For the configuration shown in FIG. 7E, the UI can also include a button to push for capturing a target light impinging on a sensor, e.g. the imaging sensor in the camera, in the smart phone 700 for copying the target light for reproduction by the selected lamp. The smart phone captures the light. Once the target light has been captured by the smart phone sensor, the smart phone wirelessly transmits the captured light information to the wireless controller 740 through the communications port 702. The wireless controller 740 communicates with the selected lamp to execute the process shown in FIGS. 2A-2D above for finding the operating point of the lamp that generates light that reproduces the target light.

The UI can also include a way for the user to initiate calibration of the selected lamp. When the smart phone receives the initiate calibration command, it wirelessly transmits the calibration command to the wireless controller 740. The wireless controller 740 then communicates with the selected lamp to perform the calibration process shown in FIG. 4 above.

In all of the configurations discussed in FIGS. 7A-7E, the smart phone provides the user interface, information received from the user through the user interface is transmitted by the smart phone to the controller, adapter, or wireless controller to process and communicate with the selected lamp.

Figure 9:
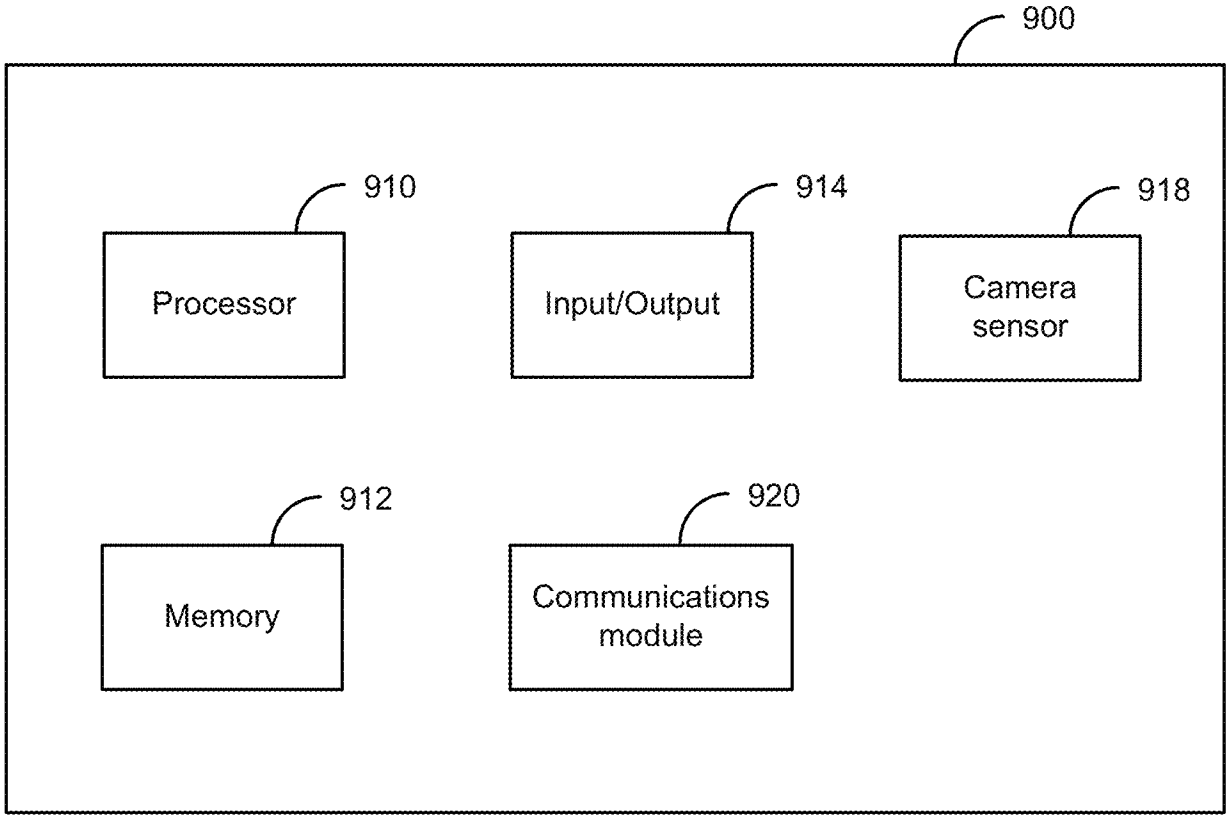
FIG. 9 depicts a block diagram illustrating an example of a smart phone 900 that displays a user interface for a user to provide commands to control an LED-based lamp.

FIG. 9 depicts a block diagram illustrating an example of a smart phone 900 that displays a user interface for a user to provide commands to control an LED-based lamp. The smart phone 900 can include one or more processors 910, memory units 912, input/output devices 914, camera sensor 918, and communications module 920.

A processor 910 can be used to control the smart phone 900 and to run a user interface program that allows a user to control an LED-based lamp. Memory units 912 include, but are not limited to, RAM, ROM, and any combination of volatile and non-volatile memory. One or more of the memory units 912 can store a user interface application program that is run by the processor 910.

Input/output devices 914 can include, but are not limited to, visual displays, speakers, and communication devices that operate through wired or wireless communications, such as a mouse for controlling a cursor. The camera sensor 918 can include an imaging device for capturing images, such as a charge-couple device (CCD). The communications module 920 can be used to communicate with an external unit that communicates with the LED-based lamp to be controlled.

Figure 10:
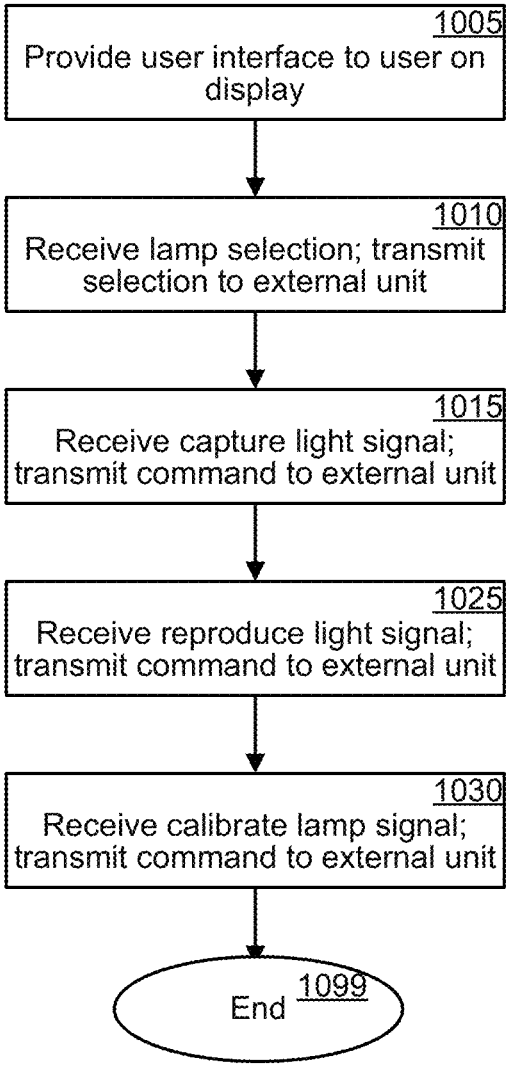
FIG. 10 is a flow diagram illustrating an example process of providing a user interface to a user for controlling an LED-based lamp.

FIG. 10 is a flow diagram illustrating an example process of providing a user interface to a user for controlling an LED-based lamp. At block 1005, the smart phone processor provides a user interface on a display of the smart phone for the user to control an LED-based lamp.

Then at block 1010, the smart phone receives a lamp selection from the user through the user interface and transmits the lamp selection to the external unit that communicates with the lamp. The external unit can be a controller, adapter, or Bluetooth device, as described above.

Next, at block 1015 the smart phone receives a signal from the user through the user interface to capture a sample of a target light that is impinging on a sensor. In one embodiment, the sensor is in the smart phone, and the user has aimed the sensor of the smart phone toward the target light. In one embodiment, the sensor is part of the external unit, and the user has aimed the sensor of the external unit toward the target light. If the sensor is in the smart phone, the smart phone captures the target light and transmits the sensor readings to the external unit. If the sensor is in the external unit, the smart phone transmits the capture light command to the external unit.

At block 1025 the smart phone receives a signal from the user through the user interface to reproduce the target light that was captured with the selected lamp and transmits the command to the external unit. The external unit communicates with the lamp using the process described in FIGS. 2A-2D above. If the sensor is in the smart phone, the external unit communicates with the smart phone to capture the light when the lamp has notified the external unit that it has generated the requested light. The smart phone captures the light and transmits the sensor readings to the external unit for processing.

At block 1030, the smart phone receives a signal from the user through the user interface to calibrate the selected lamp and transmits the command to the external unit. The external unit communicates with the lamp using the process described in FIG. 4 above. If the sensor is in the smart phone, the external unit communicates with the smart phone to capture the light when the lamp has notified the external unit that it needs a sensor reading. The smart phone captures the light and transmits the sensor readings to the external unit for re-transmitting to the lamp for processing.

Figure 11:
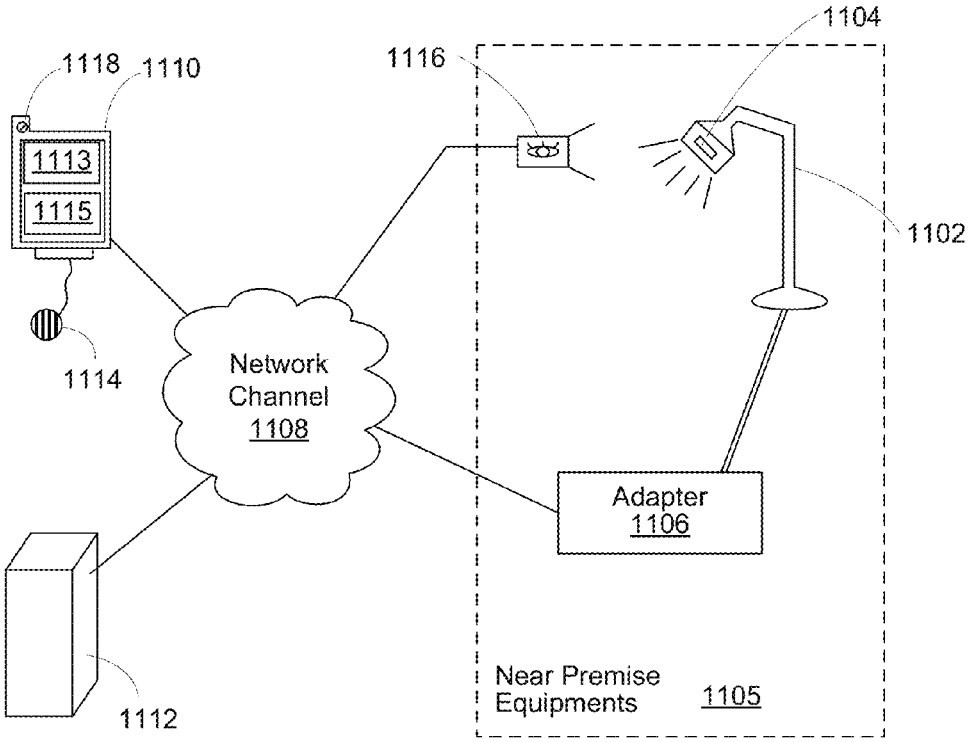
FIG. 11 is a control flow illustrating an example of a mobile device controlling a color tunable LED-based lamp.

FIG. 11 illustrates a light control system 1100 to communicate with a LED-based lamp 1102. The LED-based lamp 1102 includes a communication module 1104. The communication module 1104 enables the LED-based lamp 1102 to communicate with external devices, such as near premise equipments 1105. Near premise equipments 1105 can communicate with the communication module 1104. Near premise equipments 1105 may include an adaptor 1106. The adaptor 1106 can relay commands and messages between the communication module 1104 and a network channel 1108.

The adaptor 1106 is an electronic device for relaying lighting control messages. The adaptor 1106 can be a router or switch-type device. The adaptor 1106 can include a processor and a non-transitory memory device. For example, the adaptor 1106 can communicate with the communication module 1104 via bluetooth, ZigBee, ultra-wideband, Lutron™ lighting control protocol, digital addressable lighting interface (DALI), digital multiplex (DMX), over power line communication, or any combination thereof.

The network channel 1108 includes one or more communication networks that may be linked together, including local area and/or wide area networks, using both wired and wireless communication systems. The network channel 1108 may include links using technologies such as Ethernet, 802.11, worldwide interoperability for microwave access (WiMAX), Bluetooth, ultra-wideband (UWB), Direct Connect, 3G, 4G, CDMA, digital subscriber line (DSL), etc. The network channel 1108 can be any number of ways to connect to the Internet, including DSL and cable. The network channel 1108 can include Ethernet, cable, phone lines, local area networks, cellular networks including SMS network, or any combination thereof. In one embodiment, the network channel 1108 uses standard communications technologies and/or protocols. Similarly, the networking protocols used on the network channel 1108 may include multiprotocol label switching (MPLS), transmission control protocol/Internet protocol (TCP/IP), User Datagram Protocol (UDP), hypertext transport protocol (HTTP), simple mail transfer protocol (SMTP) and file transfer protocol (FTP). Data exchanged over the network channel 1108 may be represented using technologies and/or formats including hypertext markup language (HTML) or extensible markup language (XML). In addition, all or some of links can be encrypted using conventional encryption technologies such as secure sockets layer (SSL), transport layer security (TLS), and Internet Protocol security (IPsec).

A mobile device 1110 can communicate via the network channel 1108 to the adaptor 1106 to relay commands and messages to the LED-based lamp 1102. Alternatively, the mobile device 1110 can communicate via the network channel 1108 to a computer server system 1112 and the computer server system 1112 via the network channel 1108 to the adaptor 1106. The mobile device 1110 can also communicate directly with the LED-based lamp 1102 with the addition of a dongle device 1114. The dongle device 1114 can communicate directly with the LED-based lamp 1102 when plugged into the mobile device 1110.

The mobile device 1110 is a portable electronic device having a processor and a non-transitory storage medium with stored instructions executable by the processor. The mobile device 1110 can be a smart phone, a tablet, an e-reader, a smart accessory, such as smart glasses, smart watches, or smart music players, or any combination thereof. The mobile device 1110 includes and executes an operating system, such as Android or iOS, to facilitate execution of mobile applications on the operating system. The mobile device 1110 is capable of determining its location via a locator module 1115 on the mobile device 1110. The mobile device 1110 can include a light control module 1113. The light control module 1113 is a mobile application running on the operating system of the mobile device 1110. The light control module 1113 can provide a user interface of a smart phone with the controls described in FIGS. 7A-7E and FIGS. 8A-8D.

For example, the light control module 1113 can configure the CCT level, brightness, or hue of the LED-based lamp 1102. The light control module 1113 can calibrate the LED-based lamp 1102 as well as dictate the LED-based lamp 1102 to match a color spectrum stored on or accessible by the mobile device 1110. The color spectrum can be captured by a camera 1118 of the mobile device 1110 or downloaded onto the mobile device 1110 from an external location. For example, the light control module 1113 can activate one of the near premise equipments 1105, such as a light sensor 1116, to capture a color spectrum of the LED-based lamp 1102. The color spectrum can then be stored in a memory of the LED-based lamp 1102 or on the mobile device 1110. At a later time, the light control module 1113 can command the LED-based lamp 1102 to match the capture spectrum stored previously.

The light control module 1113 can further command the LED-based lamp 1102 to calibrate itself, as by the methods described above. The light control module 1113 can activate a security system to adjust the LED-based lamp 1102 upon detection of movement. The light control module 1113 can schedule CCT, brightness, and hue changes at specific time of the day or of the week.

The mobile device 1110 can also receive messages from the LED-based lamp 1102. For example, the mobile device 1110 can receive messages regarding a calibration status, a fault detection status, a power consumption status, an estimated life time of light sources of the LED-based lamp 1102, a temperature at the LED-based lamp 1102, or any combination thereof.

The mobile device 1110 can further send commands to the LED-based lamp 1102 passively (i.e. without user control). For example, the mobile device 1110 can include a locator device, such as a global positioning system (GPS) receptor. The locator device can be compared to a location address of the LED-based lamp 1102 accessible through the adaptor 1106. When the mobile device 1110 is away from the LED-based lamp 1102, the mobile device 1110 can automatically send out a command to dim the LED-based lamp 1102. The LED-based lamp 1102 can be configured to be turned on or brighten when the mobile device 1110 is near.

The mobile device 1110 can schedule commands to be sent to the LED-based lamp 1102 by queuing commands with the adaptor 1106. The adaptor 1106 can be a programmable device capable of storing logics and conditionals that are associated with a command to be sent to the LED-based lamp 1102 to adjust the LED-based lamp 1102.

The mobile device 1110 and/or the adaptor 1106 can update the color model store on the LED-based lamp 1102. The mobile device 1110 and/or the adaptor 1106 can also update a light rendering engine of the LED-based lamp 1102, where the light rendering engine is a programmable logic stored on the LED-based lamp 1102 that determines how to adjust the control signals of LED strings on the LED-based lamp 1102 based on the color model.

The computer server system 1112 can provide intelligence to filter, authenticate, or prioritize messages and commands sent between the mobile device 1110 and the LED-based lamp 1102. Messages and commands can then travel from the mobile device 1110 to the computer server system 1112, the computer server system 1112 to the adaptor 1106, and then the adaptor 1106 to the LED-based lamp 1102. The computer server system 1112 can provide a web interface similar to the light control module 1113 described on the mobile device 1110 that is capable of sending and receiving commands and messages to and from the LED-based lamp 1102. The web interface can serve as an alternative of the light control module 1113 to control and monitor the LED-based lamp 1102.

The computer server system 1112 is an electronic system including one or more devices with computing functionalities. The computer server system 1112 includes at least a processor and a non-transitory storage medium (i.e., memory). The computer server system 1112 can execute instructions, stored on the memory, to filter, authenticate, and prioritize messages and commands via the processor. For example, the computer server system 1112 can be a computer cluster, a virtualize computing environment, or a cloud computing platform. The computer server system 1112 can be a desktop computer, a laptop computer, a server computer, or any combination thereof.

Figure 12:
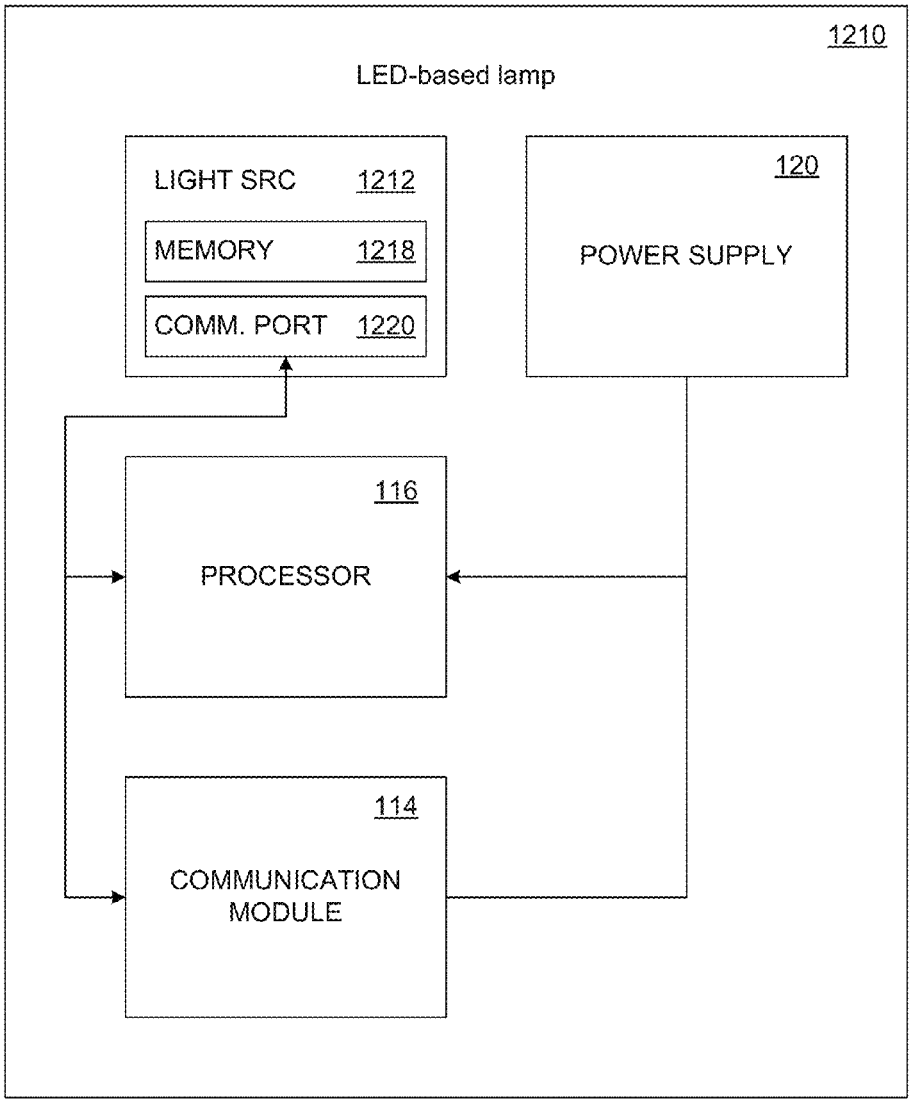
FIG. 12 illustrates a block diagram of another example configuration of a LED-based lamp.

FIG. 12 illustrates an example configuration of a LED-based lamp 1210. FIG. 1 illustrates that the light source 112, the memory 118, the processor 116, the communications module 114 and the power supply 120 are all part of the LED-based lamp 110. FIG. 12, on the other hand, shows that the light source 1212 has its own memory 1218. The light source 1212 can be a portable unit of one or more LED color strings and the memory 1218. The light source 1212 can be modularly plugged into the LED-based lamp 1210 and detached from the LED-based lamp. The communication port 1220 can be a separate communication socket, plug, cable, pin, or interface that can be coupled to the processor 116 and/or the communication module 114. The communication port 1220 can be part of the power supply line from the power supply 120 to the light source 1212.

The memory 1218 can be accessed through a communication port 1220. The memory can store a color model and/or a histogram of the one or more LED color strings in the light source 1212. The color model and/or the histogram can be created or updated via the communication port 1220. The processor 116 can drive the one or more LED color strings according to commands received from the communication module 114 based on the color model or the histogram accessed from the memory 1218. The processor 116 and the communication module 114 can communicate with the communication port 1220 with a separate connection line or a power supply line from the power supply 120 that connects the light source 1212, the processor 116, and the communication module 114.

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or subcombinations. Also, while processes or blocks are at times shown as being performed in series, these processes or blocks may instead be performed or implemented in parallel, or may be performed at different times. Further, any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the invention.

Any patents and applications and other references noted above, including any that may be listed in accompanying filing papers, are incorporated herein by reference. Aspects of the invention can be modified, if necessary, to employ the systems, functions, and concepts included in such references to provide further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms. For example, while only one aspect of the invention is recited as a means-plus-function claim under 35 U.S.C. §112, sixth paragraph, other aspects may likewise be embodied as a means-plus-function claim, or in other forms, such as being embodied in a computer-readable medium. (Any claims intended to be treated under 35 U.S.C. §112, ¶6 will begin with the words "means for.") Accordingly, the applicant reserves the right to add additional claims after filing the application to pursue such additional claim forms for other aspects of the invention.

We claim:

1. A method of operating a mobile device to control a light-emitting diode (LED)-based lamp, comprising:

providing a user interface to be displayed to a user, wherein the user interface includes:

a first control for selecting a lamp, a second control for capturing with a sensor a target light having a target spectrum, and a third control for initiating generation by the lamp a light having a light spectrum that substantially matches the target spectrum;

receiving a lamp command through the user interface to select a preferred lamp;

receiving a capture command through the user interface to capture the target light at the sensor;

receiving a reproduction command through the user interface to generate the target spectrum with the preferred lamp; and transmitting the received commands from the mobile device to an external controller, wherein the external controller is configured to communicate with the preferred lamp to determine an operating point of the preferred lamp that generates light having a light spectrum substantially matching the target spectrum.

2. The method of claim 1, wherein the mobile device transmits the received commands through a cable from a communications port of the mobile device to the external controller, and further wherein the external controller includes the sensor.

3. The method of claim 1, wherein the mobile device transmits the received commands through a communications port to the external controller, and wherein the external controller directly plugs into the communications port, and further wherein the external controller includes the sensor.

4. The method of claim 1, further comprising:

capturing the target light with the sensor, wherein the sensor is part of the mobile device;

transmitting sensor readings captured by the sensor to the external controller; and transmitting the lamp command and the reproduction command to the external controller, wherein the external controller communicates with the mobile device to obtain sensor readings for light generated by the preferred lamp, and wherein transmitting the sensor readings and the commands comprises transmitting the sensor readings and the commands from a communications port of the mobile device to the external controller, wherein the external controller is directly plugged into the communications port.

5. The method of claim 4, wherein the user interface includes a fourth control that permits the user to operate a zoom control in the mobile device to select a particular target light impinging on the sensor.

6. The method of claim 1, further comprising:

capturing the target light with the sensor, wherein the sensor is part of the mobile device;

wirelessly transmitting sensor readings captured by the sensor to the external controller; and wirelessly transmitting the lamp command and the reproduction command to the external controller, wherein the external controller wirelessly communicates with the mobile device to obtain sensor readings for light generated by the preferred lamp.

7. The method of claim 6, wherein the user interface includes a fourth control that permits the user to operate a zoom control in the mobile device to select a particular target light impinging on the sensor.

8. A method of operating a mobile device to control a lamp, comprising: providing a user interface to be displayed to a user, wherein the user interface includes:

a first control for selecting a lamp, and a second control for calibrating the lamp; receiving a lamp command through the user interface to select a preferred lamp;

receiving a calibrate command through the user interface to calibrate the lamp; and transmitting the received commands from the mobile device to an external controller, wherein the external controller communicates with the preferred lamp during a calibration process to provide sensor readings for calibration measurements.

9. The method of claim 8, wherein the mobile device transmits the received commands through a cable from a communications port of the mobile device to the external controller, and further wherein the external controller includes a sensor configured to provide sensor readings corresponding to light generated by the preferred lamp.

10. The method of claim 8, wherein the mobile device transmits the received commands through a communications port to the external controller, and wherein the external controller directly plugs into the communications port, and further wherein the external controller includes a sensor configured to provide sensor readings corresponding to light generated by the preferred lamp.

11. The method of claim 8, further comprising:

transmitting the lamp command and the calibrate command to the external controller, wherein the mobile device includes a sensor configured to provide sensor readings corresponding to light generated by the preferred lamp, and wherein the external controller communicates with the mobile device to obtain the sensor readings;

wherein communications between the mobile device and the external controller occur via a communications port of the mobile device; and wherein the external controller is directly plugged into the communications port.

12. The method of claim 11, wherein the user interface includes a third control that permits the user to operate a zoom control in the mobile device to select a particular portion of an active area of the sensor for sensor readings.

13. The method of claim 8, further comprising:

wirelessly transmitting the lamp command and the calibrate command to the external controller, wherein the mobile device includes a sensor configured to provide sensor readings corresponding to light generated by the preferred lamp, and wherein the external controller wirelessly communicates with the preferred lamp during the calibration process, and the external controller wirelessly communicates with the mobile device to obtain the sensor readings.

14. The method of claim 13, wherein the user interface includes a third control that permits the user to operate a zoom control in the mobile device to select a particular portion of an active area of the sensor for sensor readings.

15. A system comprising:

a display;

a memory component for storing a software program;

an input/output device;

a communications module;

a processor coupled among the display, the memory component, the input/output device, and the communications module, wherein the processor is configured to execute the software program, the software program comprising:

a first module operable to generate a user interface on the display and to receive from the user using the input/output device and the user interface a selection of a preferred lamp, a capture command for capturing with a sensor a target light having a target spectrum, and a reproduction command for initiating generation by the preferred lamp a light having a light spectrum that substantially matches the target spectrum; and a second module operable to transmit using the communications module the selection of the lamp, and the reproduction command to an external controller, wherein the external controller communicates with the preferred lamp to generate light to determine an operating point of the preferred lamp that generates light having the light spectrum substantially matching the target spectrum.

16. The system of claim 15, wherein the sensor is part of the external controller, and the second module is further operable to transmit the capture command to the external controller.

17. The system of claim 16, wherein the first module is further operable to receive from the user a calibrate command for calibrating the preferred lamp, and further wherein the second module is further operable to transmit using the communications module the calibrate command to the external controller, and the external controller communicates with the preferred lamp during a calibration process to provide sensor readings for calibration measurements.

18. The system of claim 15, wherein the system further comprises the sensor, and wherein the software program further comprises a third module operable to capture the target light with the sensor, and wherein the second module is further operable to transmit sensor readings from the sensor to the external controller.

19. The system of claim 18, wherein the first module is further operable to receive from the user a calibrate command for calibrating the preferred lamp, the third module is further operable to capture, with the sensor, light generated by the preferred lamp during a calibration process, and the second module is further operable to transmit using the communications module the calibrate command and sensor readings to the external controller, and wherein the external controller communicates with the preferred lamp during the calibration process to provide sensor readings from the sensor for calibration measurements.

20. The system of claim 19, wherein the communications module communicates wirelessly with the external controller.

21. A mobile device comprising:

a display;

a memory component for storing a mobile application; and a processor configured to execute an operating system and the mobile application;

wherein the mobile application is configured to:

render an interface on the display to select a LED-based lamp;

render on the display a monitor dashboard of real-time status of the LED-based lamp; and send a message to an adaptor to relay a command to adjust illumination of the LED-based lamp.

22. The mobile device of claim 21, further comprising a locator module configured to report a location of the mobile device; wherein the mobile application is configured to send the message to adjust illumination based on a relative distance of the mobile device from a lamp location of the LED-based lamp.

23. The mobile device of claim 21, further comprising a camera configured to capture a color spectrum; wherein the mobile application is configured to send the message to adjust illumination of the LED-based lamp to match the captured color spectrum.

24. The mobile device of claim 21, wherein the mobile application is configured to update a color model the LED-based lamp.

25. The mobile device of claim 21, wherein the mobile application is configured to program the LED-based lamp on how to utilize a color model to adjust the illumination of the LED-based lamp.

26. The mobile device of claim 21, wherein the mobile application is configured to communicate directly with the LED-based lamp via a dongle device.

27. A server system comprising:

a memory component for storing executable instructions; and a processor configured to execute the executable instructions;

wherein the executable instructions are configured to:

render an interface on a browser of a client device to select a LED-based lamp;

render on the interface a monitor dashboard of real-time status of the LED-based lamp; and send a message to an adaptor to relay a command to adjust illumination of the LED-based lamp.

* * * * *